US008459629B2

(12) United States Patent
Abe

(10) Patent No.: US 8,459,629 B2
(45) Date of Patent: Jun. 11, 2013

(54) SHEET PROCESSING APPARATUS AND IMAGE FORMING APPARATUS

(75) Inventor: Hideto Abe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 92 days.

(21) Appl. No.: 12/960,682

(22) Filed: Dec. 6, 2010

(65) Prior Publication Data

US 2011/0140335 A1 Jun. 16, 2011

(30) Foreign Application Priority Data

Dec. 16, 2009 (JP) ..... 2009-284651
Nov. 24, 2010 (JP) ..... 2010-260746

(51) Int. Cl.
*B31F 1/00* (2006.01)

(52) U.S. Cl.
USPC ..... 270/45; 270/32; 270/58.17; 270/58.27

(58) Field of Classification Search
USPC ..... 270/32, 45, 58.07, 58.17, 58.27; 493/406, 493/407, 442, 454
See application file for complete search history.

(56) References Cited

U.S. PATENT DOCUMENTS 7,284,752 B2 * 10/2007 Nagata et al. ..... 270/58.18
7,396,006 B2 * 7/2008 Kapturowski et al. ..... 270/52.14
7,431,273 B2 * 10/2008 Kamiya et al. ..... 270/37
7,431,274 B2 * 10/2008 Kushida et al. ..... 270/37
2003/0031532 A1 2/2003 Nolte et al.
2009/0103962 A1 * 4/2009 Fujii et al. ..... 399/404
2010/0258994 A1 * 10/2010 Kikkawa et al. ..... 270/37
2012/0045295 A1 * 2/2012 Sato ..... 412/33

FOREIGN PATENT DOCUMENTS

GB 2381237 A 4/2003
JP 2003-228205 A 8/2003

* cited by examiner

*Primary Examiner* — Leslie A Nicholson, III

(74) *Attorney, Agent, or Firm* — Fitzpatrick, Cella, Harper & Scinto

(57) ABSTRACT

A sheet processing apparatus comprises: a conveying portion which contacts a doubled up booklet and conveys the booklet; an end conveying portion which abuts against an open end of the booklet and pushes out the booklet, thereby conveying the booklet; a stopper which abuts against a back of the booklet to position the booklet; a holding portion which holds the booklet which abuts against the stopper; a processing portion which processes the booklet held by the holding portion; wherein the conveying portion can come into contact with and separate from the booklet, the conveying portion separates from the booklet, or a pressure for bringing the conveying portion into contact with the booklet is reduced before the back of the booklet abuts against the stopper, the back of the booklet is abutted against the stopper by the end conveying portion and then, the holding portion holds the booklet.

24 Claims, 20 Drawing Sheets

SHEET PROCESSING APPARATUS AND IMAGE FORMING APPARATUS

BACKGROUND OF THE INVENTION

1. Field of the Invention

The present invention relates to a sheet processing apparatus which holds a doubled up booklet and subjects the booklet to predetermined processing, and the invention also relates to an image forming apparatus having the sheet processing apparatus.

2. Description of the Related Art

Conventionally, if a batch of sheets (twenty or more sheets) are folded in two by one operation, a spine (back) portion is apparently curved, and a completed booklet has insufficient folded portion. Therefore, there is provided an apparatus which flattens the spine of a batch of sheets, thereby sharply folding the sheets to enhance the folding performance as described in a specification of U.S. Patent Application Publication No. 2003/0031532.

FIG. 18A illustrates a configuration of the apparatus. A booklet H which was folded by one operation is nipped by a pair of belts 51*a* and 51*b* and conveyed, the booklet H abuts against a tip end stopper 52*a* and then, the booklet H is held by holding portions 54 and 55. If the holding operation is completed, a pressure roller 59 presses a back of the booklet H, and sharply folds the back while moving. FIG. 18B illustrates a state where the booklet H is held by the holding portions 54 and 55.

Conventionally, to enhance storage performance of a saddle stitched booklet, a unit apparatus for forming holes through which the booklet is bound with a string is provided by Japanese Patent Laid-open No. 2003-228205.

FIG. 19A illustrates a configuration of the punch apparatus. The saddle stitched booklet H is nipped by a belt 61 and conveying rollers 62 and 63 and conveyed, the booklet H abuts against a tip end stopper 64 and thereafter, a holding portion 65 is lowered and the booklet H is held. If the holding operation is completed, a punching portion 66 punches holes in the booklet H. FIG. 19B illustrates a state where the booklet is held by the holding portion 65.

According to the conventional configuration, however, since the booklet H is nipped and conveyed and is abutted against the tip end stopper 52*a* as illustrated in FIG. 19B, there is an adverse possibility that several sheets from the outermost sheet to inner sheets near a back H1 of the booklet H which abuts against the tip end stopper 52*a* sag. In this case, even if the booklet is held thereafter, the sag remains. This phenomenon outstandingly appears when a friction coefficient of a surface of the outermost sheet of the booklet is high (no image) and a friction coefficient of the other surface is low (entire surface is color photograph). The phenomenon also appears when the outermost sheet of the booklet is thinner than center sheets and the outermost sheet has lower rigidity. Large creases as illustrated with portions C in FIG. 20A are generated due to this sag when the back H1 of the held booklet H is sharply folded. When holes are formed near the back H1 of the booklet H, since positions of holes are deviated as illustrated in FIG. 20B, quality of the booklet is deteriorated.

To eliminate the sag, it is conceived to stop the conveying motion at the instant when the booklet abuts against the tip end stopper or to stop the booklet without providing the tip end stopper. However, in the former method, if the booklet skew fed, this skew feeding can not be corrected. To correct the skew feeding, even after one end of the booklet abuts against the tip end stopper, the conveying motion of the booklet for allowing the other end to abut against the tip end stopper must be continued. As a result, a sag is generated. In the latter method, skew feeding of the booklet can not be corrected of course, and since stopping precision depends on precision of a sending amount of the conveying portion, if slip is generated between the booklet and the conveying portion, the stopping precision is largely deteriorated. It seems to be possible to push a rear end of a booklet in which a sag is generated and convey the booklet without nipping and conveying the booklet. However, if a folded portion of the booklet which was folded in two is not nipped, the folded portion of the booklet swells, and then, the booklet cannot proceed between the holding portions before lowering the holding portions.

SUMMARY OF THE INVENTION

Hence, it is an object of the present invention to correct skew feeding of a booklet, to prevent sags of several sheets from the outermost sheet to inner sheets of the booklet, and to prevent quality from being deteriorated when a booklet having a sag is subjected to processing.

The present invention provides a sheet processing apparatus comprises: a conveying portion which contacts a doubled up booklet and conveys the booklet; an end conveying portion which abuts against an open end of the booklet and pushes out the booklet, thereby conveying the booklet; a stopper which abuts against a back of the booklet to position the booklet; a holding portion which holds the booklet which abuts against the stopper; a processing portion which processes the booklet held by the holding portion; wherein the conveying portion can come into contact with and separate from the booklet, the conveying portion separates from the booklet, or a pressure for bringing the conveying portion into contact with the booklet is reduced before the back of the booklet abuts against the stopper, the booklet is conveyed by the end conveying portion, the back of the booklet abuts against the stopper and then, the holding portion holds the booklet.

Further features of the present invention will become apparent from the following description of exemplary embodiments with reference to the attached drawings.

DESCRIPTION OF THE EMBODIMENTS

Exemplary embodiments of the present invention will be described in detail with reference to the drawings. Sizes, materials, shapes and relative positions of constituent parts described in the embodiments are appropriately changed in accordance with configurations and various conditions of the apparatus to which the invention is applied. Therefore, the scope of the invention is not limited to those unless such sizes, materials, shapes or relative positions are specifically described.

[First Embodiment]

Figure 1:
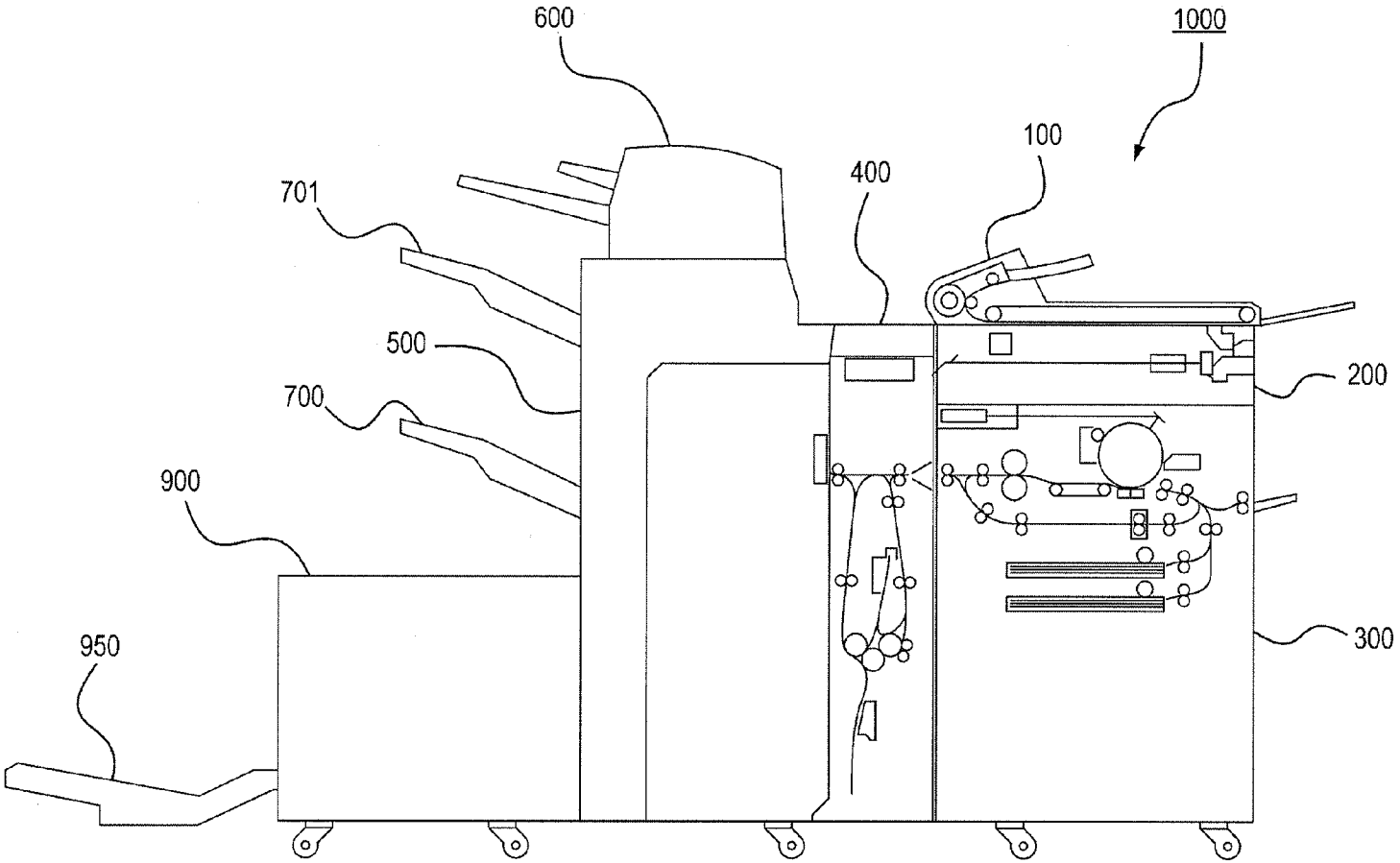
FIG. 1 is a front sectional view of an apparatus illustrating a copier and a finisher.

An entire configuration of a sheet processing apparatus having a booklet processing apparatus and an entire configuration of an image forming apparatus will be described using FIG. 1. FIG. 1 is a sectional view illustrating an inner structure of a copier 1000 as the image forming apparatus to which the sheet processing apparatus can be applied.

Figure 4:
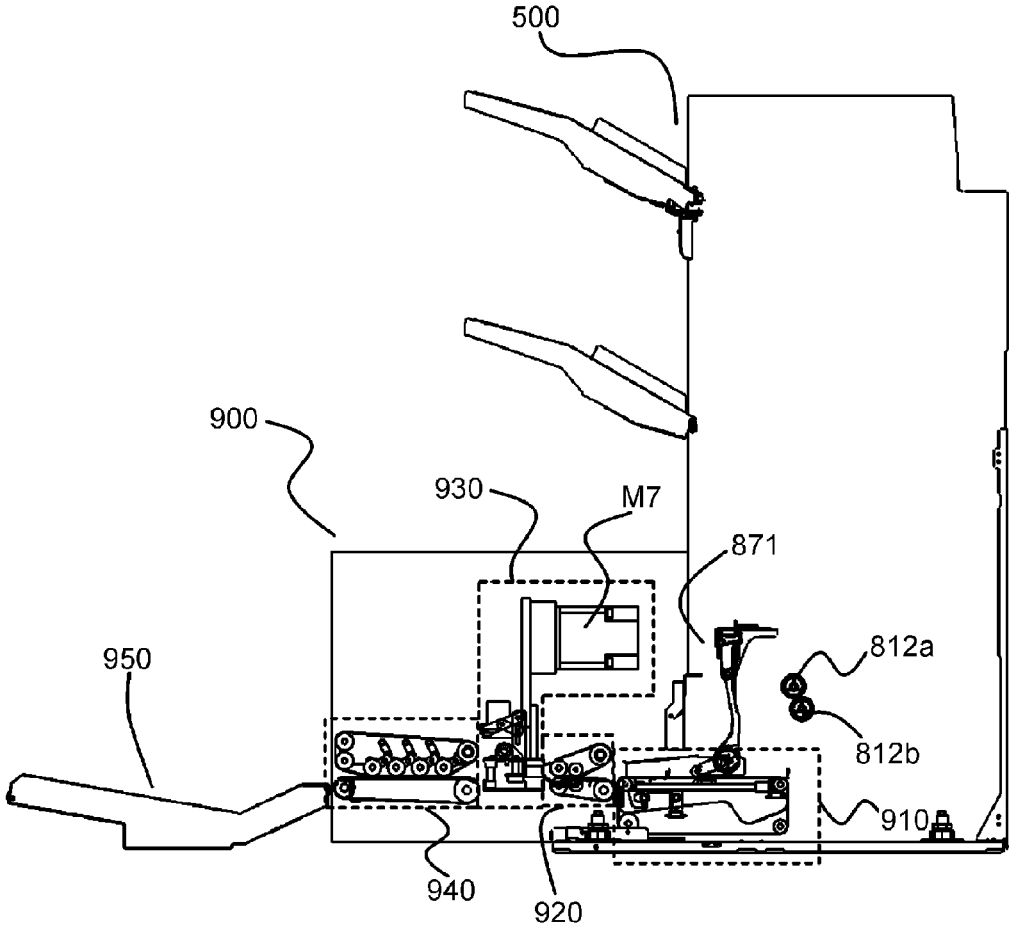
FIG. 4 is a front sectional view of a booklet processing apparatus.

The copier 1000 includes an original feeding portion 100, an image reading portion 200, a printing portion 300, a folding processing portion 400, a finisher 500, an inserter 600 and a booklet processing apparatus 900 (see FIG. 4). The folding processing portion 400, the finisher 500, the inserter 600 and the booklet processing apparatus 900 may be provided as optional sheet processing apparatuses.

The original feeding portion 100 sequentially feeds originals one sheet by one sheet toward an image reading position of the image reading portion 200. The image reading portion 200 reads an image of the original. The printer 300 includes an image forming portion having a photosensitive drum, a developing apparatus and transferring portion, and the printer 300 toner-develops an electrostatic latent image formed on the photosensitive drum by a developing apparatus based on image information of the original which was read by the image reading portion 200 or based on image information which was sent. Toner image is transferred to a sheet which was fed to a transferring portion with right timing, the transferred toner image is fixed onto the sheet by heat and pressure in a fixing apparatus, and an image is formed.

The finisher 500 takes in, from the printer 300, sheets on which images are formed, aligns the plurality of taken sheets, and binds the sheets as one batch. The finisher 500 also staples rear ends of the sheets (binding process), and punching holes in the rear ends of the sheets (punching process). The finisher 500 also carries out processes such as sort process, non-sort process and saddle stitch binding process.

Figure 2:
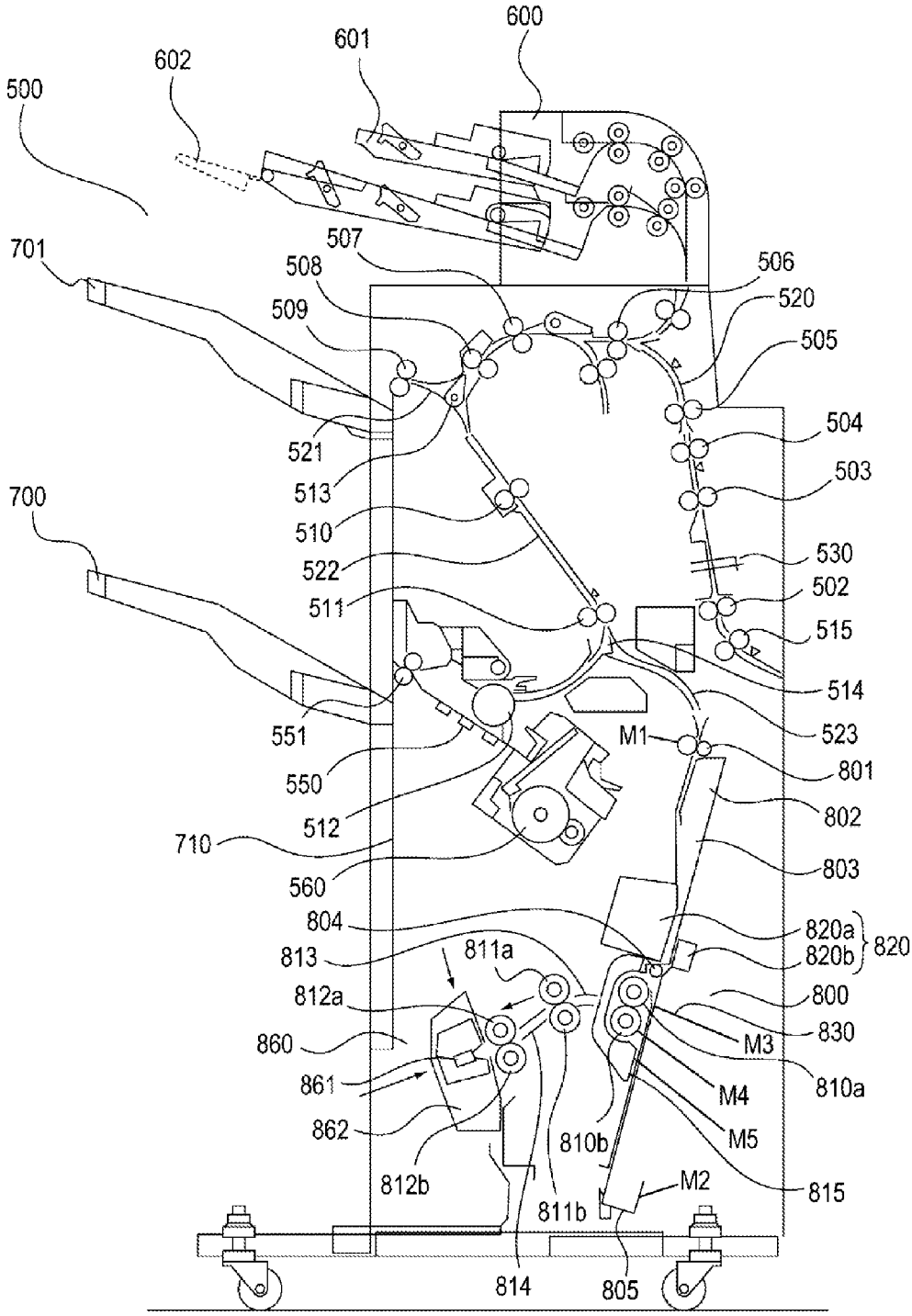
FIG. 2 is a detailed front sectional view of the finisher.

A configuration of the sheet processing apparatus will be described together with flow of sheets. As illustrated in FIG. 2, the finisher 500 has a conveying path 520 for taking, into the apparatus, sheets conveyed through the folding processing portion 400. The conveying path 520 is provided with a pair of input rollers 515 and pairs of conveying rollers 502 to 508 in this order. A punch unit 530 as a punching portion is provided between the pair of conveying rollers 502 and the pair of conveying rollers 503. The punch unit 530 carries out operation as required, and carries out punching holes in rear ends of conveyed sheets. A changeover member 513 provided with the end of the conveying path 520 downstream side of the punching processing portion switches between an upper discharge path 521 and a lower discharge path 522 connected to a downstream side. The upper discharge path 521 discharges sheets to a stack tray 701 by a pair of upper discharge rollers 509. The lower discharge path 522 has pairs of conveying rollers 510, 511 and 512, and discharges sheets to a processing tray 550. Sheets discharged into the processing tray 550 are sequentially aligned and accommodated in a form of a batch, and the sheets are sorted and stapled in accordance with setting from the operation portion 1 (see FIG. 3). Thereafter, the sheets are selectively discharged into stack trays 700 and 701 by a pair of sheets discharge rollers 551.

The stapling processing is carried out by a stapler 560 as a binding portion. The stapler 560 can move in the width direction which intersects with a conveying direction of sheets, and can staple at any position of the sheets. The stack trays 700 and 701 can move in the vertical direction. The upper stack tray 701 can receive sheets from the upper discharge path 521 and the processing tray 550, and the lower stack tray 700 can receive sheets from the processing tray 550. A large amount of sheets or batches of sheets can be loaded on the stack trays 700 and 701, and rear ends of the loaded sheets are regulated by a rear end guide 710 which extends in the vertical direction and are aligned.

Next, a configuration of a saddle stitch binding portion 800 in the finisher 500 will be described. The saddle stitch binding portion is a processing portion selectively carries out binding process to a plurality of sheets or batches of sheets and thereafter, folds the sheets in two and makes so-called booklets. Details will be described below.

A changeover member 514 is provided at an intermediate portion of the lower discharge path 522, and a sheet is switched to the right side by the changeover member 514, the sheet passes through a saddle discharge path 523 and is sent to a saddle stitch binding portion 800. The sheet is delivered to a pair of saddle input rollers 801, an incoming opening is selected by a changeover member 802 which is operated by a solenoid in accordance with size, and the sheet is conveyed into an accommodation guide 803 of the saddle stitch binding portion 800. The conveyed sheet is conveyed the slide roller 804 until a tip end thereof comes into contact with a movable sheet positioning member 805. A motor M1 drives the pair of saddle input rollers 801 and the slide roller 804. Staplers 820 as binding portions are provided at an intermediate position of the accommodation guide 803 such as to be opposed to each other with the accommodation guide 803 interposed therebetween. The stapler 820 is divided into a driver 820*a* that projects staples and an anvil 820*b* that bends the projected staples. When a sheet is conveyed in, the sheet positioning member 805 stops at a position where a central portion of the sheet positioning member 805 in a sheet-conveying direction comes to a binding position of the stapler 820. The sheet positioning member 805 is driven by a motor M2 and can move and changes a position in accordance with a sheet size.

A pair of bending rollers 810*a* and 810*b* are provided downstream of the stapler 820, and a projecting member 830 which constitutes a bending portion together with the pair of bending rollers 810*a* and 810*b* is provided at a position where the pair of bending rollers 810*a* and 810*b* are opposed to each other. A home position of the projecting member 830 is a position retracted from the accommodation guide 803. The projecting member 830 is driven by a motor M3 and projects toward the accommodated sheets, pushes the sheets into a nip of the pair of bending rollers 810*a* and 810*b* and folds the sheets in two. Thereafter, the projecting member 830 again returns to the home position. A pressure F1 sufficient to crease the sheets is applied between the pair of bending rollers 810 by a spring (not illustrated). The creased sheets are discharged into a booklet processing apparatus 900 through the pair of first bending conveying rollers 811*a* and 811*b*, and the pair of second bending conveying rollers 812*a* and 812*b*. Pressures F2 and F3 sufficient to convey and stop creased sheets are applied also to the pair of first bending conveying rollers 811 and the pair of second bending conveying rollers 812.

A conveying guide 813 connects the pair of bending rollers 810 and the pair of first bending conveying rollers 811 with each other. A conveying guide 814 connects the pair of first bending conveying rollers 811 and the pair of second bending conveying rollers 812 with each other. The pair of bending rollers 810, the pair of first bending conveying rollers 811 and the pair of second bending conveying rollers 812 are rotated by the same motor M4 at equal speed.

The folding operation of sheets bound by the stapler 820 is carried out after the sheet positioning member 805 is lowered, by a predetermined distance, from a position where the stapling process is carried out so that the stapling position of the sheets becomes a nip position of the pair of bending rollers 810 after the stapling process. According to this, the sheets can be folded in two at the position where the stapling process is carried out.

A pair of aligning plates 815 is an aligning portion which aligns sheets accommodated in the accommodation guide 803, and includes a surface projecting toward the accommodation guide 803 while sandwiching outer peripheral surfaces of the pair of bending rollers 810*a* and 810*b*. The pair of aligning plates 815 is driven by a motor M5, and moves in a inserting direction with respect to the sheets, and positions the sheets in the width direction.

A crease press unit 860 is provided downstream of the pair of second bending conveying rollers 812. The crease press unit 860 includes a press holder 862 which supports a pair of press rollers 861, and the crease press unit 860 moves the press holder 862 in a crease direction in a state where the pair of press rollers 861 nip the crease, thereby reinforcing the crease.

The inserter 600 feeds sheets which are set in insert trays 601 and 602 by a user toward stack trays 701 and 700 or toward the saddle stitch binding portion without through the printer 300. Sheets loaded on the insert trays 601 and 602 are sequentially separated one sheet by one sheet, and they merge with each other into the conveying path 520 at desired timing.

Figure 3:
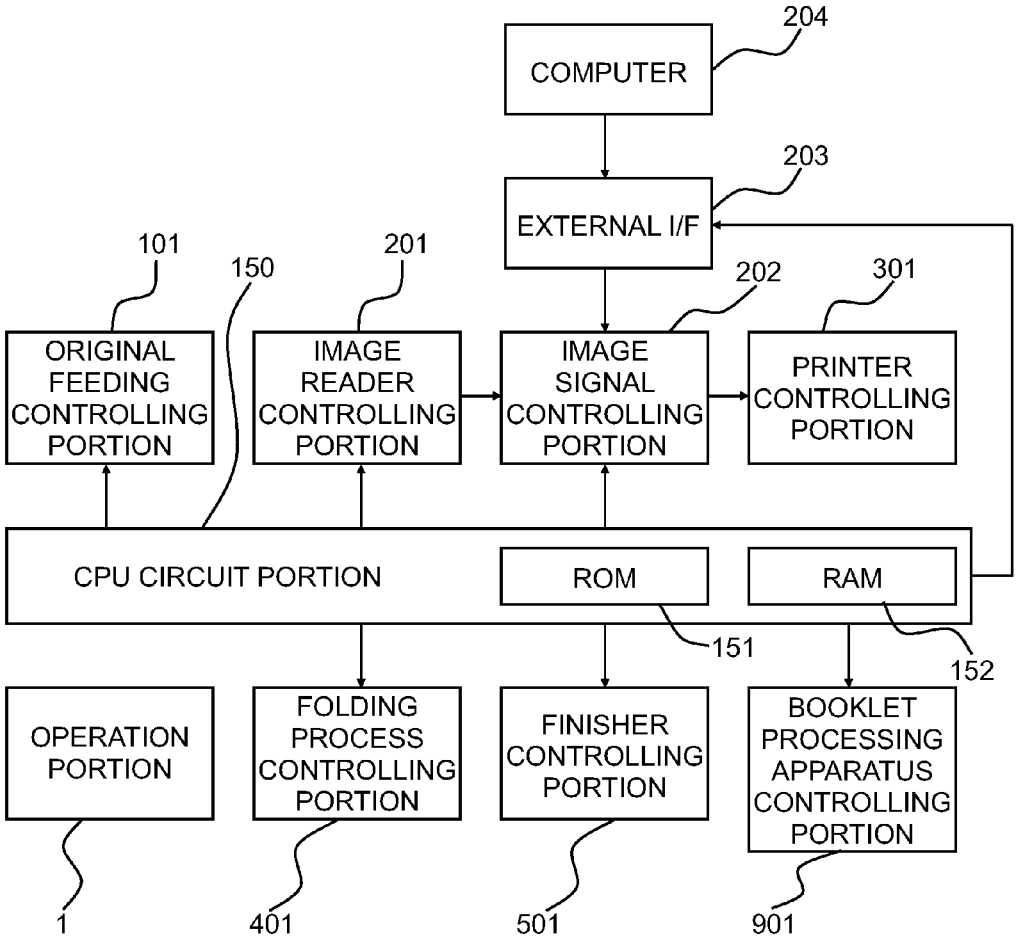
FIG. 3 is a block diagram of the entire apparatus.

FIG. 3 is a block diagram of the copier 1000. A CPU circuit portion 150 has a CPU (not illustrated), and controls the following elements in accordance with a control program stored in a ROM 151 and in accordance with setting of the operation portion 1. That is, the CPU circuit portion 150 controls an original feeding controlling portion 101, an image reader controlling portion 201, an image signal controlling portion 202, a printer controlling portion 301, a folding process controlling portion 401, a finisher controlling portion 501, a booklet processing apparatus controlling portion 901 and an external I/F 203. The original feeding controlling portion 101 controls the original feeding portion 100. The image reader controlling portion 201 controls the image reading portion 200. The printer controlling portion 301 controls the printer 300. The folding process controlling portion 401 controls the folding processing portion 400. The finisher controlling portion 501 controls the finisher 500, the saddle stitch binding portion 800 and the inserter 600 which function as the sheet processing apparatus. The booklet processing apparatus controlling portion 901 controls the booklet processing apparatus. The operation portion 1 includes a plurality of keys for setting various functions concerning image formation, and a display portion on which a set state is displayed. The operation portion 1 outputs, to the CPU circuit portion 150, a key signal corresponding to an operation of each key carried out by a user, and displays corresponding information on the display portion based on a signal from the CPU circuit portion 150.

The RAM 152 is used as an area for temporarily retaining the control data or as a working area for computation involved with the control. The external I/F 203 is an interface between the copying machine 1000 and an external computer 204. It expands the print data from the computer 204 into a bit-mapped image, and outputs the resultant to the image signal controlling portion 202 as image data. An image of an original which was read by an image sensor (not illustrated) is input to the image signal controlling portion 202 from the image reader controlling portion 201. The printer controlling portion 301 outputs the image data from the image signal controlling portion 202 to the exposure controlling portion (not illustrated).

Next, the booklet processing apparatus 900 will be described using FIGS. 4 to 12. FIG. 4 is a front sectional view of the booklet processing apparatus 900. The booklet processing apparatus 900 includes a receiving unit 910, a pair of conveying belts 920, a back processing unit 930, a pair of discharge belts 940 and a tray 950. A booklet P is discharged into the receiving unit 910 of the booklet processing apparatus 900 by the pair of second bending conveying rollers 812*a* and 812*b* of the saddle stitch binding portion 800. The receiving unit 910 receives booklets. The pair of conveying belts 920 are conveying portions which contact the booklet and conveys the same. Here, the pair of conveying belts 920 nip the booklet and convey the same. The back processing unit 930 processes a back of a booklet. The pair of discharge belts 940 discharges a booklet outside of the apparatus. The tray 950 loads a discharged booklet.

Figure 5A:
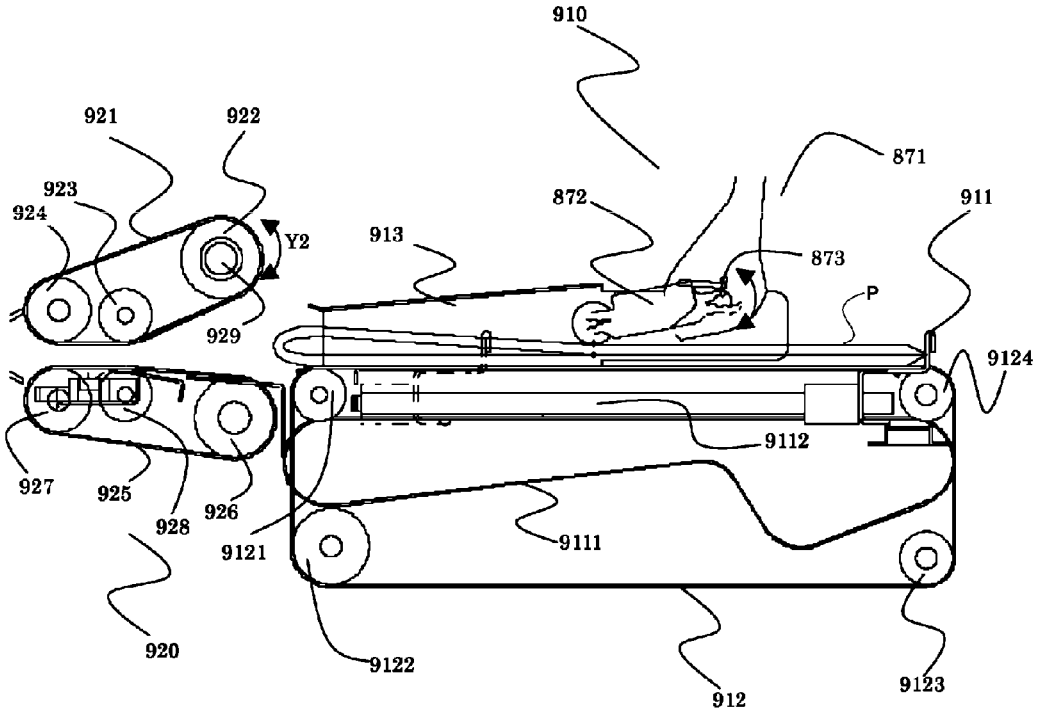
FIG. 5A is a detailed sectional view of a receiving unit and a pair of conveying rollers.
Figure 5B:
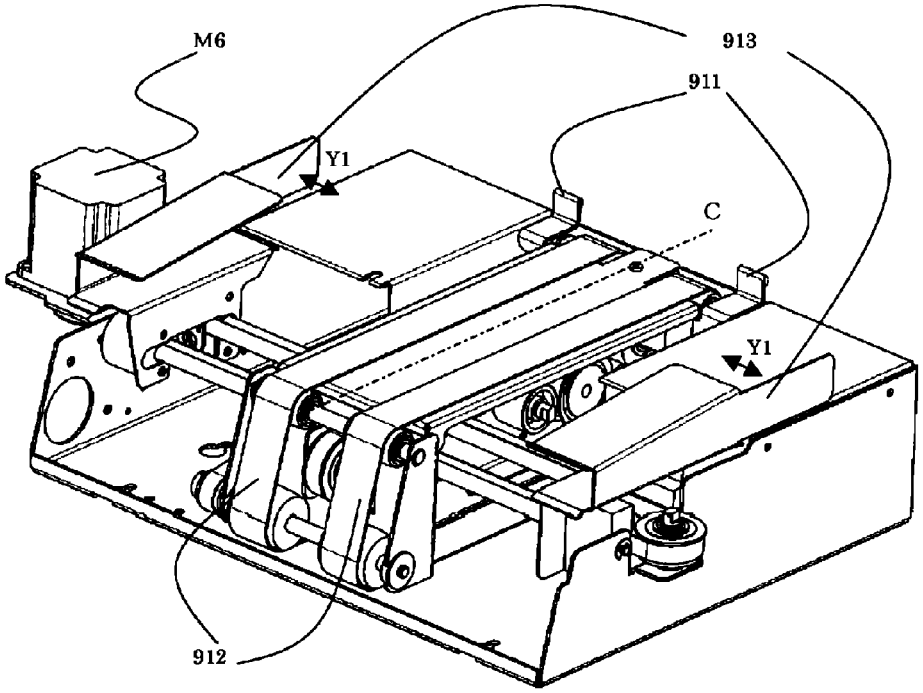
FIG. 5B is a perspective view of the receiving unit.

FIG. 5A illustrates details of the receiving unit 910 and the pair of conveying belts 920. FIG. 5B is a perspective view of the receiving unit 910. S1 to S15 in the following description correspond to flows in a flowchart illustrated in FIG. 12.

The receiving unit 910 includes a register plate 913, a conveying belt 912 which conveys a booklet, and a rear end assist 911 which abuts against and pushes out an opening end (fore edge) of the booklet on its side opposite from the spine (back), thereby conveying the booklet. The register plate 913 is driven by a motor M6 and can reciprocate in a direction of arrow Y1 in FIG. 5B, abuts against top and lower edges of the booklet to correct the skew feeding. A center of the booklet P in its vertical direction is made to match with a conveying center illustrated with a dashed line C. The conveying belt 912 extends along the belt rollers 9121 to 9124, the belt roller 9122 is rotated by a motor (not illustrated), and the conveying motion of the conveying belt 912 is carried out. The rear end assist 911 is an end conveying portion which abuts and pushes out the rear end (fore edge) of the booklet P and conveys the booklet P. The rear end assist 911 is fastened to an assist belt 9111 and can reciprocate in the horizontal direction along a slide shaft 9112.

The pair of conveying belts 920 include an upper conveying belt 921 which is a first conveying belt and a lower conveying belt 925 which is a second conveying belt provided at a position opposed to the upper conveying belt 921 through as a booklet conveying path. The upper conveying belt 921 extends along pair of belt rollers 922 to 924, and the lower conveying belt 925 extends along pair of belt rollers 926 to 928. The upper conveying belt 921 can rock in a direction of arrow Y2 around the roller shaft 929. That is, the upper conveying belt 921 can move toward and away from the booklet. The pair of belt rollers 922 are rotated by a motor (not illustrated) in the clockwise direction, thereby turning the upper conveying belt 921. The pair of belt rollers 926 are rotated by a motor (not illustrated) in the counterclockwise direction, thereby turning the lower conveying belt 925.

A booklet P which was discharged toward the receiving unit 910 is delivered to the receiving unit 910 in a state where a swelling of the booklet P is suppressed by a rocking-press 872 possessed by a sheets-pressing portion 871 of the saddle stitch binding portion 800 (S1). The rocking-press 872 of the sheets-pressing portion 871 can rock around a rocking shaft 873, and a position of the rocking-press 872 is changed depending upon a thickness of a booklet. Next, the register plate 913 abuts against top and lower edges of the booklet P, corrects the skew feeding, and retracts (S2). An open end of the booklet P whose skew feeding was corrected is pushed out by the rear end assist 911, and the booklet P is conveyed to the pair of conveying belts 920 by the conveying belt 912 (FIG. 5A, S3).

The booklet P which was delivered to the pair of conveying belts 920 is continuously conveyed to the back processing unit 930 in a state where the fore edge of the booklet P is pushed out toward the rear end assist 911. A configuration of the back processing unit 930 will be described with reference to a motion diagram of FIGS. 6 to 11 and a perspective view of FIG. 10B.

The back processing unit 930 includes a holding portion 931 which holds a booklet, a tip end stopper 932 against which a tip end (back) of the booklet abuts to correct the skew feeding and to position the booklet, and a pressure roller unit 933 which crushes a back of the held booklet. The holding portion 931, the tip end stopper 932 and the pressure roller unit 933 will be described using a detailed diagram of FIG. 7.

Figure 8A:
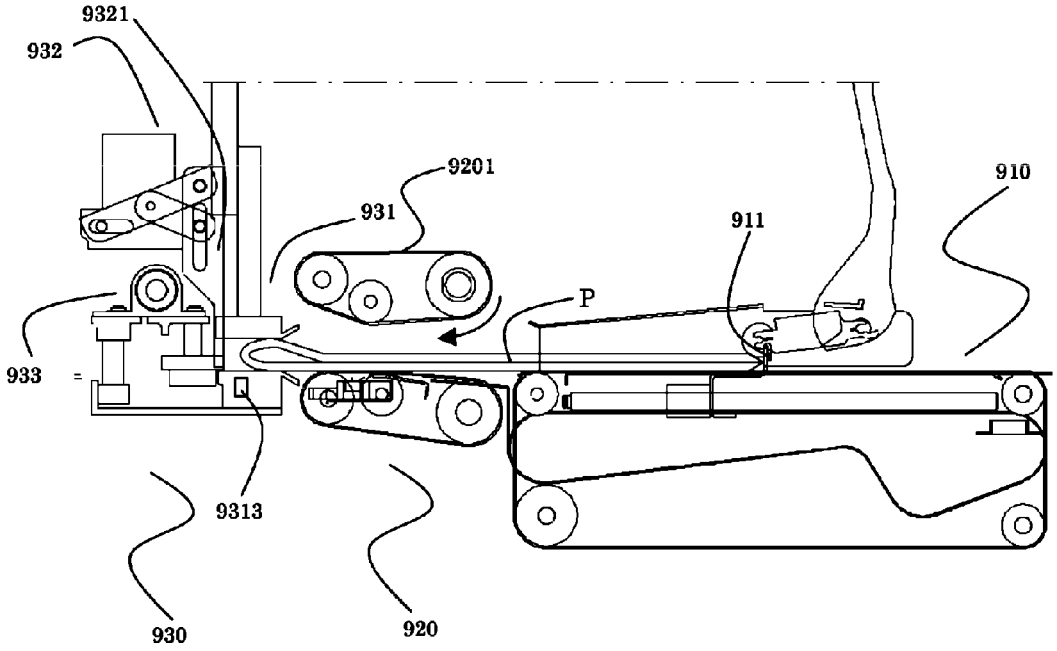
FIGS. 8A and 8B are front sectional views of the booklet processing apparatus illustrating booklet motion in the first embodiment.
Figure 8B:
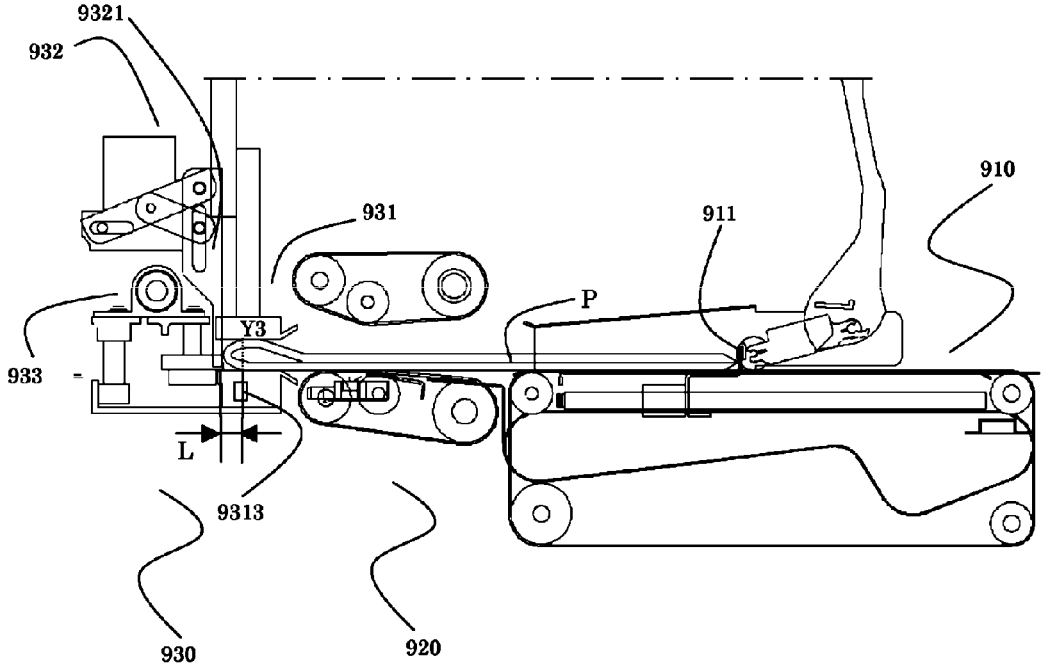
Figure 9A:
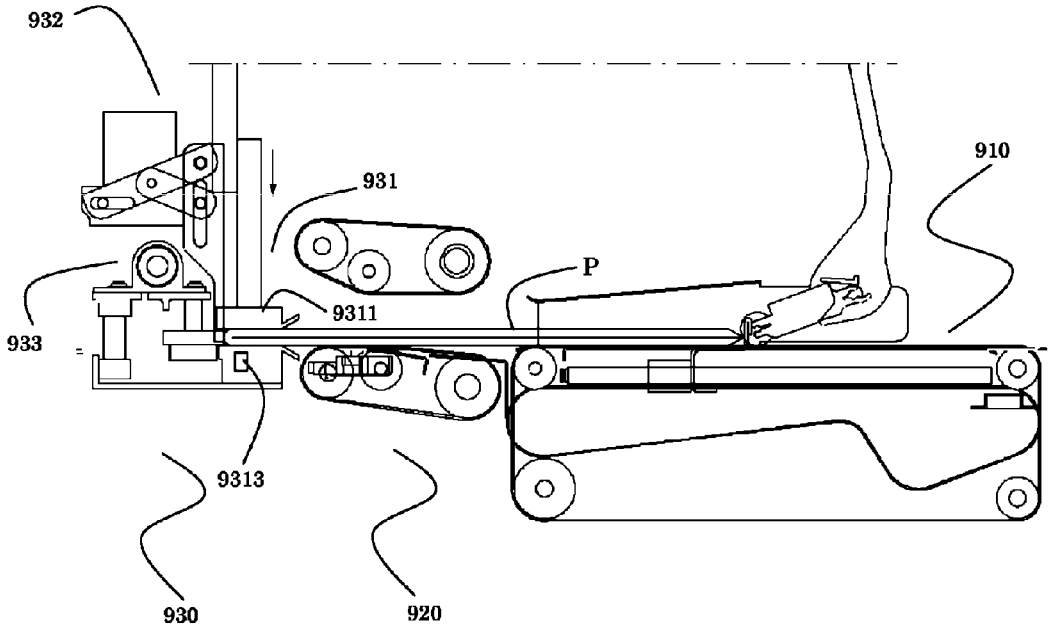
FIGS. 9A and 9B are front sectional views of the booklet processing apparatus illustrating booklet motion in the first embodiment.

The holding portion 931 holds an abutment portion area (near the back) of the booklet P which abuts against the tip end stopper 932. The holding portion 931 includes a moving block 9311 which is driven by a motor M7 and is moved in the vertical direction, and a fixing block 9312 which is on a fixing side. This motion is illustrated in FIGS. 8B and 9A. A transmission sensor 9313 as a detecting portion which detects a booklet is provided in the fixing block 9312 which is in a holding region of a booklet by the holding portion 931. If a booklet P cuts across a detection position (detection line) Y3 by the transmission sensor 9313, it is recognized that the booklet P proceeds between the moving block 9311 and the fixing block 9312. As a predetermined position where the back of the booklet abuts against a back stopper is described as the detection position provided in the holding region of the holding portion, but the invention is not limited to this. Detection of the position of the booklet is not limited to the sensor, and other configuration may be employed. For example, a position of a booklet is calculated from a conveying amount of the conveying belt.

Figure 9B:
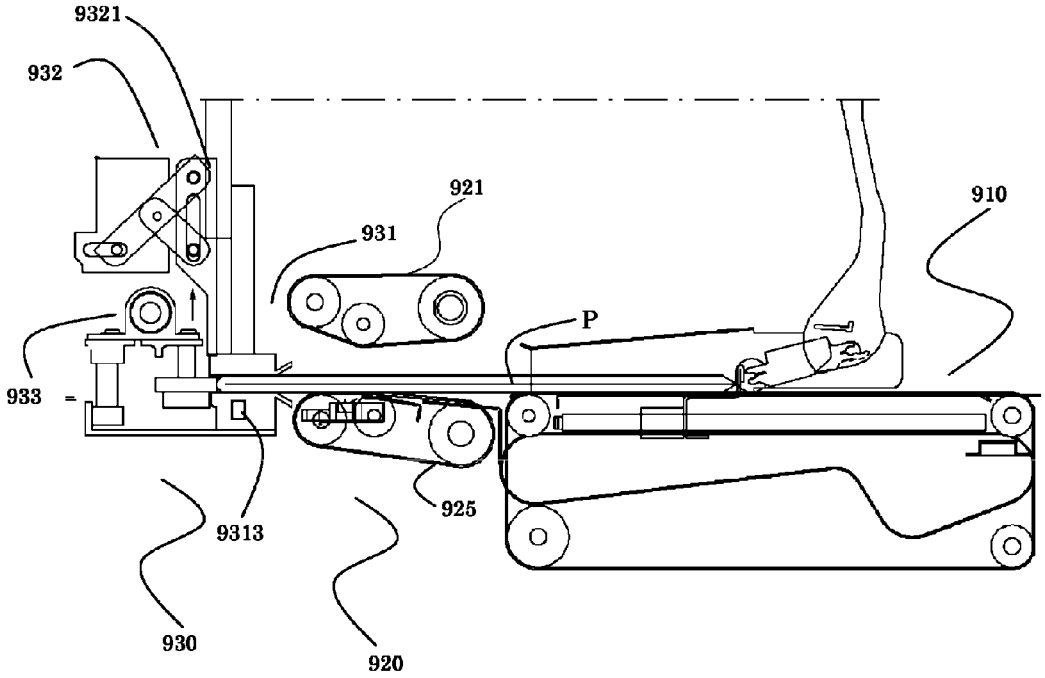

The tip end stopper 932 which is the back stopper can move in a direction perpendicular to the conveying direction of the booklet, and the tip end stopper 932 proceeds or retracts from the conveying path of the booklet. The tip end stopper 932 includes a stopper plate 9321, a first link 9322 and a second link 9323. The stopper plate 9321, the first link 9322 and the second link 9323 are rotatably fixed by rotation shafts 9324 to 9327. The rotation shaft 9327 is pushed out to rightward in the horizontal direction (direction of arrow in FIG. 7) by a solenoid (not illustrated), thereby moving the stopper plate 9321 in the vertical direction. This motion is illustrated in FIGS. 9A and 9B. At least two portions of the stopper plate 9321 of the tip end stopper 932 abut against a back of the booklet in a width direction which intersects with the conveying direction. According to this, the tip end of the booklet is positioned and the tip end is abutted to correct the skew feeding.

The pressure roller unit 933 is a deforming portion (processing portion) which moves a roller which presses the back of the booklet along the back, and deforms the back (here, sharply folding process). The pressure roller unit 933 includes a slide bearing 9331 for moving, a moving roller 9332 and a pressure roller 9333 which crushes the back of the booklet. There are a moving shaft 9334 which is fixed to a body frame (not illustrated), and a positioning plate 9335. The pressure roller unit 933 is guided by the moving shaft 9334 and a guiding surface 9336 of the positioning plate 9335 through the slide bearing 9331 and the moving roller 9332, and is moved in parallel to the back of the booklet P.

Figure 6:
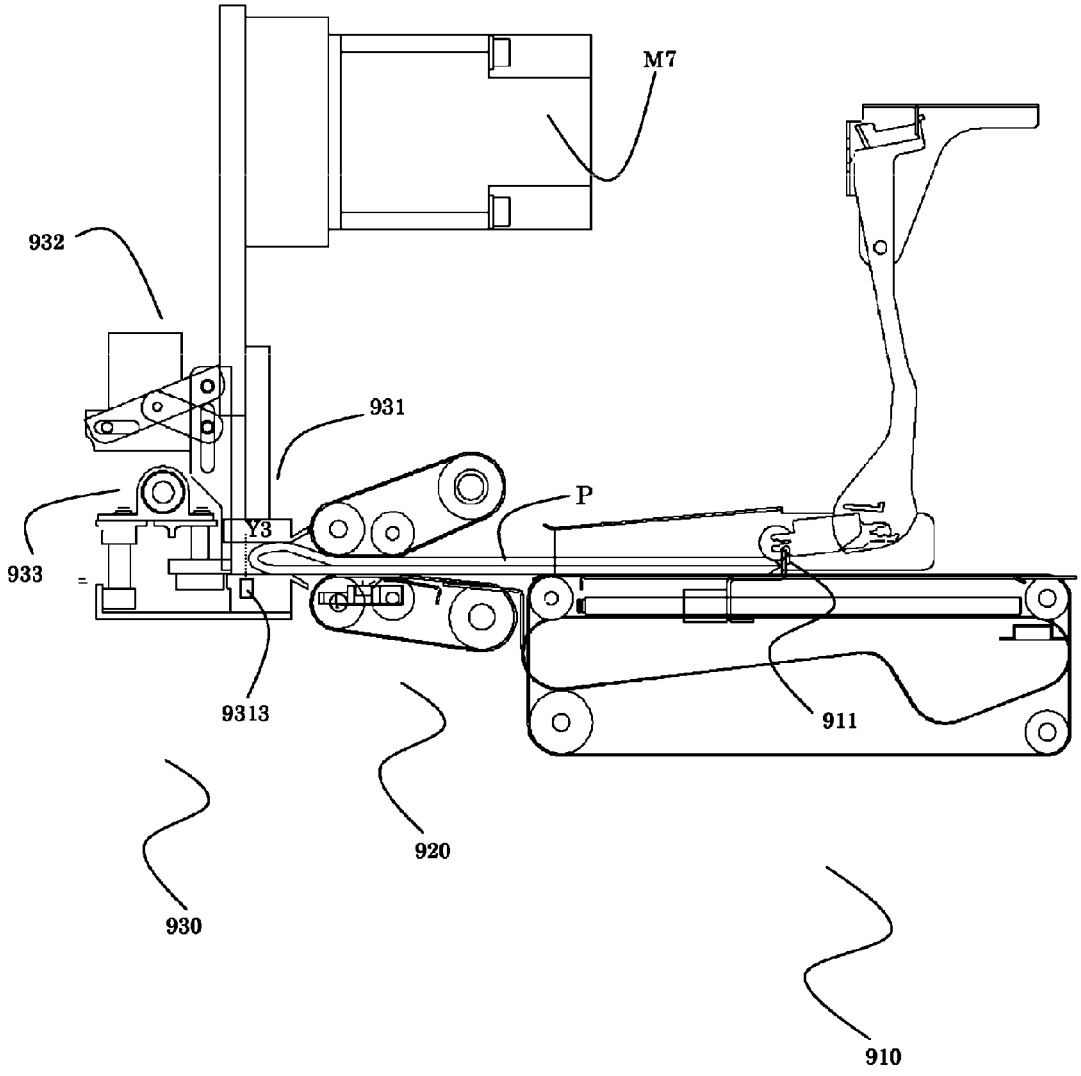
FIG. 6 is a front sectional view of a booklet processing apparatus according to a first embodiment.
Figure 7:
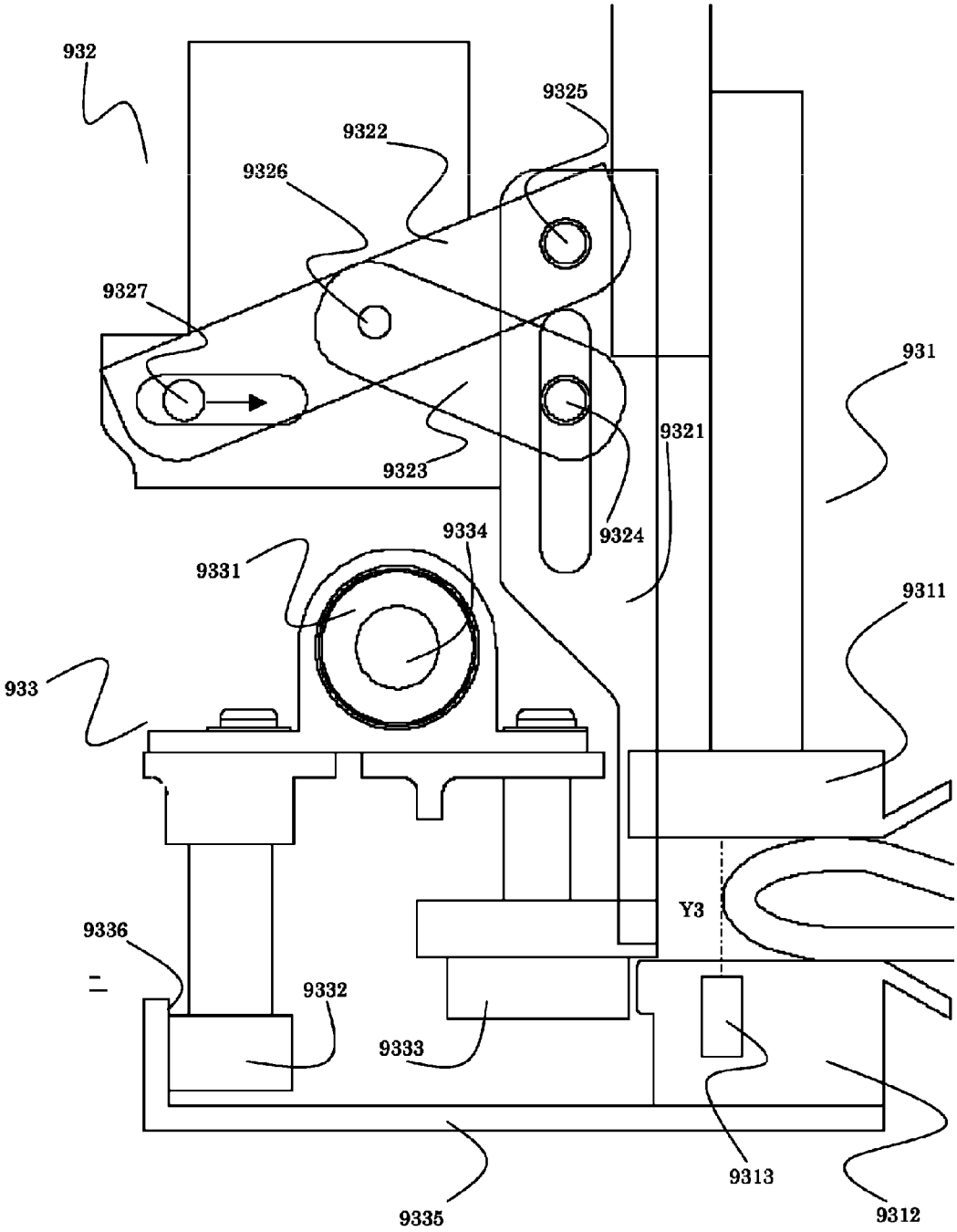
FIG. 7 is a detailed front sectional view of a back processing unit.
Figure 10A:
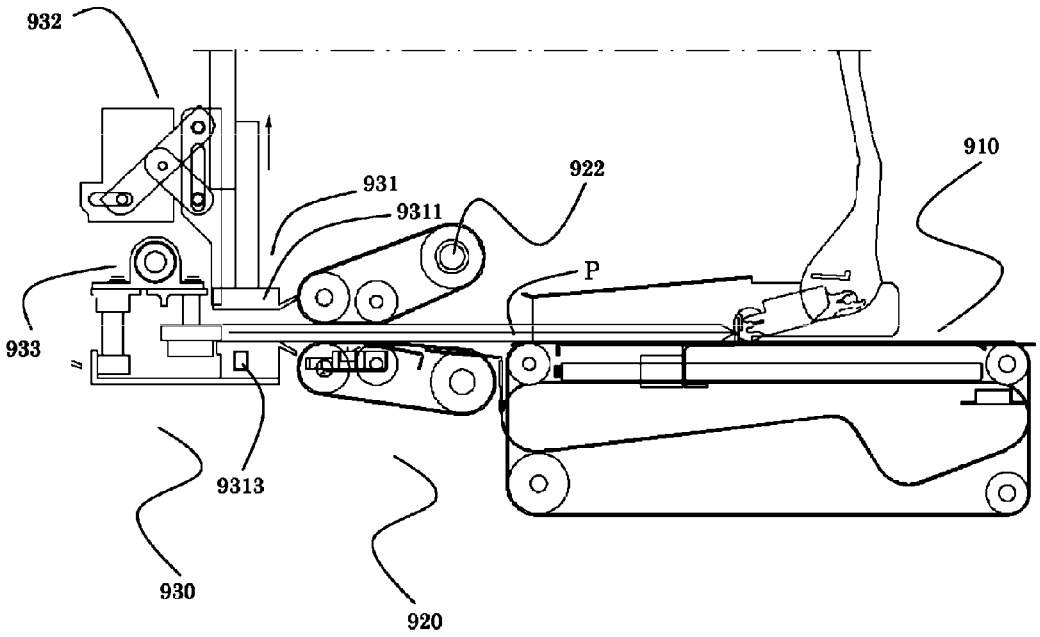
FIG. 10A is a front sectional view of the booklet processing apparatus illustrating booklet motion in the first embodiment.
Figure 10B:
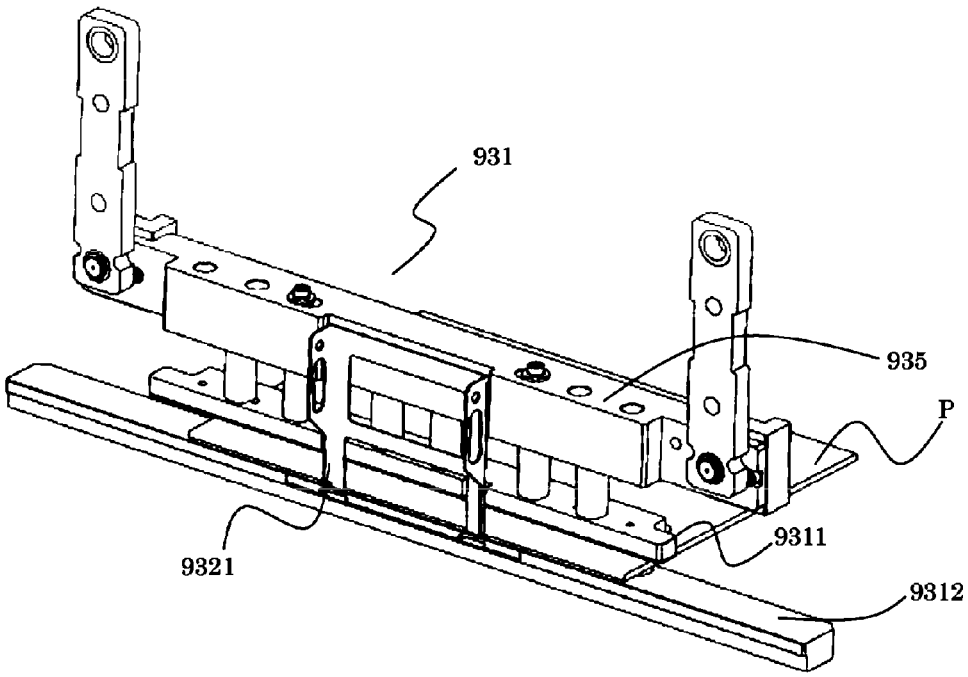
FIG. 10B is a perspective view illustrating a holding portion and a stopper plate.
Figure 11A:
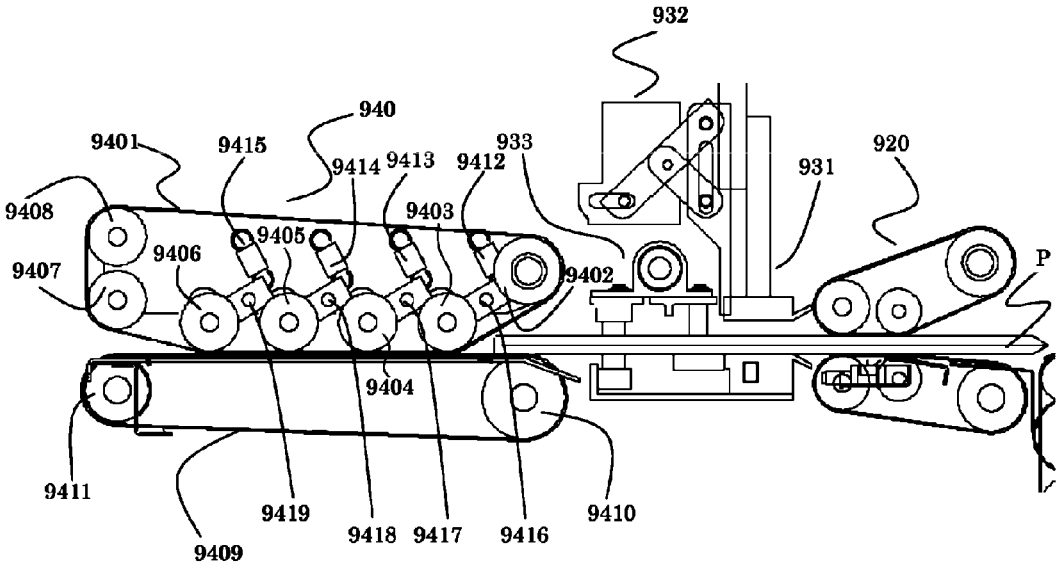
FIGS. 11A and 11B are front sectional views of the booklet processing apparatus illustrating booklet motion in the first embodiment.
Figure 11B:
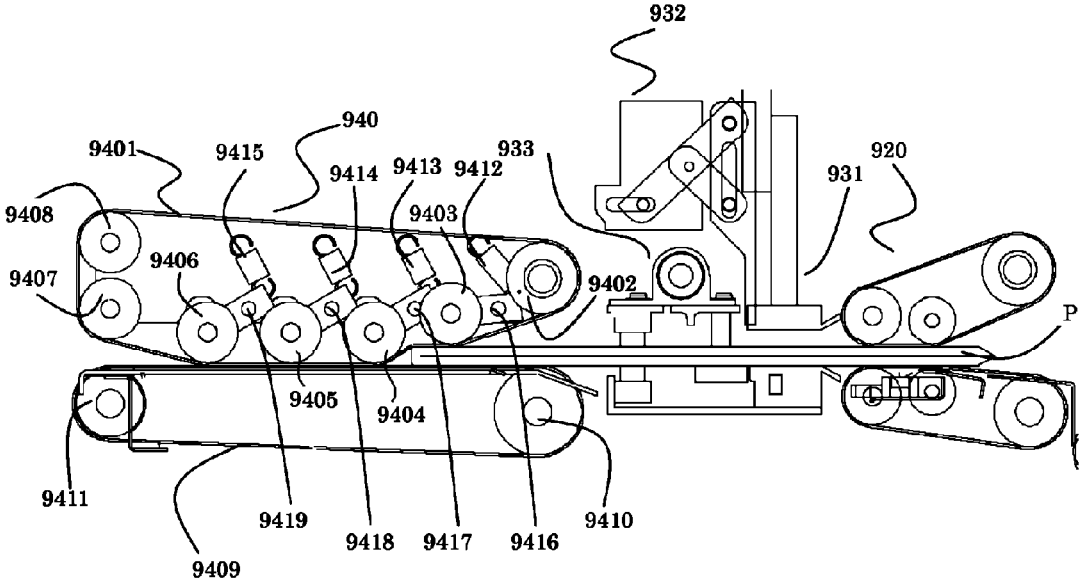

The booklet P which was conveyed to the pair of conveying belts 920 by the conveying belt 912 while being pushed out by the rear end assist 911 is continuously conveyed by the pair of conveying belts 920 while being pushed out by the rear end assist 911 (FIG. 6, S4). The back of the booklet P proceeds between the moving block 9211 and the fixing block 9312 of the holding portion 931 in a state where a swelling of the booklet P is pressed by the pair of conveying belts 920. It is determined by the transmission sensor 9313 provided in the holding portion 931 of the back processing unit whether a tip end (back) of the booklet P which is conveyed by the rear end assist 911 and the pair of conveying belts 920 reaches the detection position Y3 (S5). If the tip end of the booklet P reaches the detection position Y3 and the transmission sensor 9313 detects the booklet P, the upper conveying belt 921 of the pair of conveying belts 920 rocks in the clockwise direction around the roller shaft 9209 and separates from the booklet P (FIG. 8A, S6). The upper conveying belt 921 and the lower conveying belt 925 stop the conveying operation. Thereafter, the rear end assist 911 continuously pushes out the fore edge of the booklet P (S7), and conveys the booklet P by a distance L from the detection position Y3 to the stopper plate 9321 of the tip end stopper (S8). The booklet P is conveyed by the rear end assist 911 by the distance L, the back of the booklet P abuts against the stopper plate 9321, and the skew feeding is corrected (FIG. 8B, S9). The moving block 9311 of the holding portion 931 is lowered, and the booklet P whose skew feeding was corrected is held by the moving block 9311 (FIG. 9A, S10). When the holding operation of the booklet P is completed, the stopper plate 9321 moves upward (S11), the sharply folding process of the back of the booklet P by the pressure roller unit 933 is carried out (FIG. 9B, S12). When the sharply folding process of the back of the booklet P is completed, the moving block 9311 moves upward, and the holding state of the booklet P is released (FIG. 10A, S13). Thereafter, the upper conveying belt 921 rocks in the counterclockwise direction around the roller shaft 9209, returns to its original position, and conveys the booklet P together with the lower conveying belt 925 (FIG. 10A, S14) to the pair of discharge belts 940 (FIG. 11A).

The pair of discharge belts 940 includes an upper discharge belt 9401, rollers 9402 to 9408 which turn the upper discharge belt 9401, a lower discharge belt 9409, and rollers 9410 and 9411 which turn the lower discharge belt 9409. The rollers 9402 and 9410 are rotated by a motor (not illustrated). The rollers 9403 to 9406 can respectively rock around the rotation shafts 9416 to 9419 so that they can separate in a thickness direction of the booklet P when the booklet P proceeds. To nip and convey the booklet P, they are biased in the counterclockwise direction around the rotation shafts 9416 to 9419 by the springs 9412 to 9415.

The booklet P which was conveyed by the pair of conveying belts 920 passes between the upper discharge belt 9401 and the lower discharge belt 9409 of the pair of discharge belts 940 (FIG. 11B, S14), and is loaded on the tray 950 illustrated in FIG. 4 (S15).

As described above, according to this embodiment, when the booklet P proceeds the holding region of the holding portion 931, the upper conveying belt 921 is separated from the booklet P, and the turning operations of the upper conveying belt 921 and the lower conveying belt 925 are stopped. The back of the booklet P is abutted against the tip end stopper 932 by the conveying operation of the rear end assist 911. According to this, the skew feeding of the booklet P is corrected, sags of several sheets from the outermost sheet to inner sheets are prevented, and it is possible to prevent the quality from being deteriorated when a booklet having a sag is processed.

[Second Embodiment]

Figure 13:
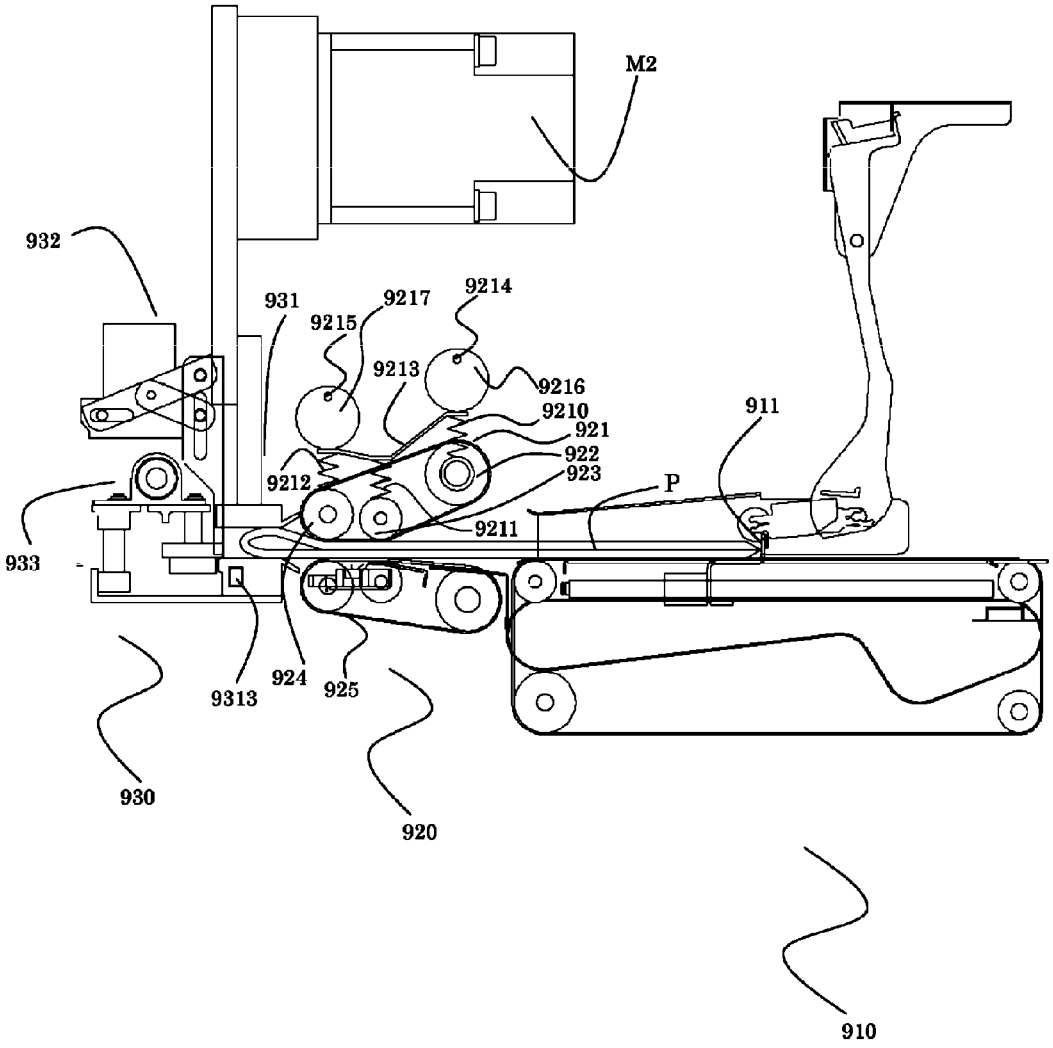
FIG. 13 is a front sectional view of a booklet processing apparatus in a second embodiment.
Figure 14A:
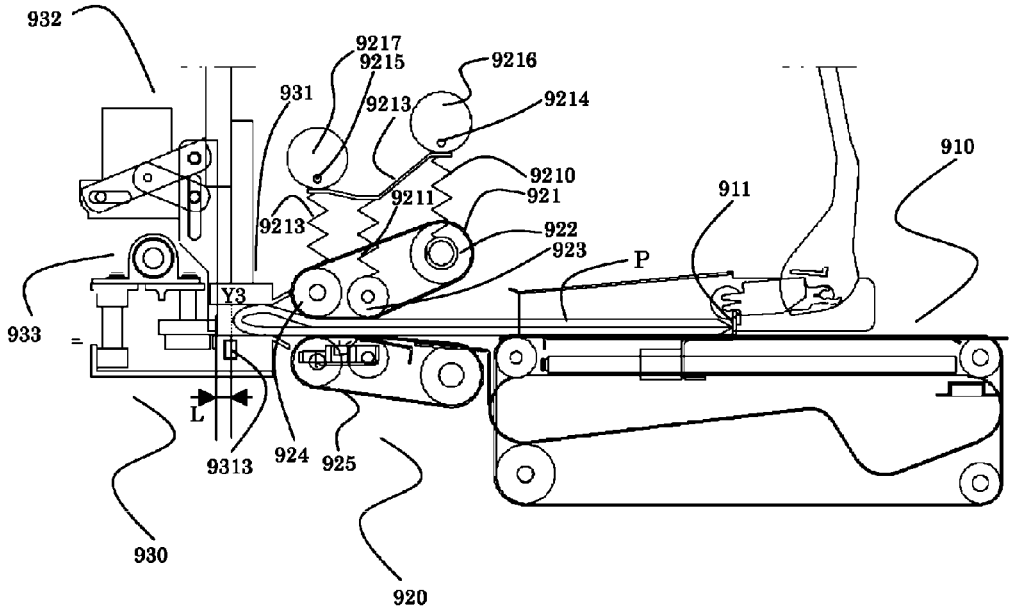
FIGS. 14A and 14B are front sectional views of the booklet processing apparatus illustrating booklet motion in the second embodiment.
Figure 14B:
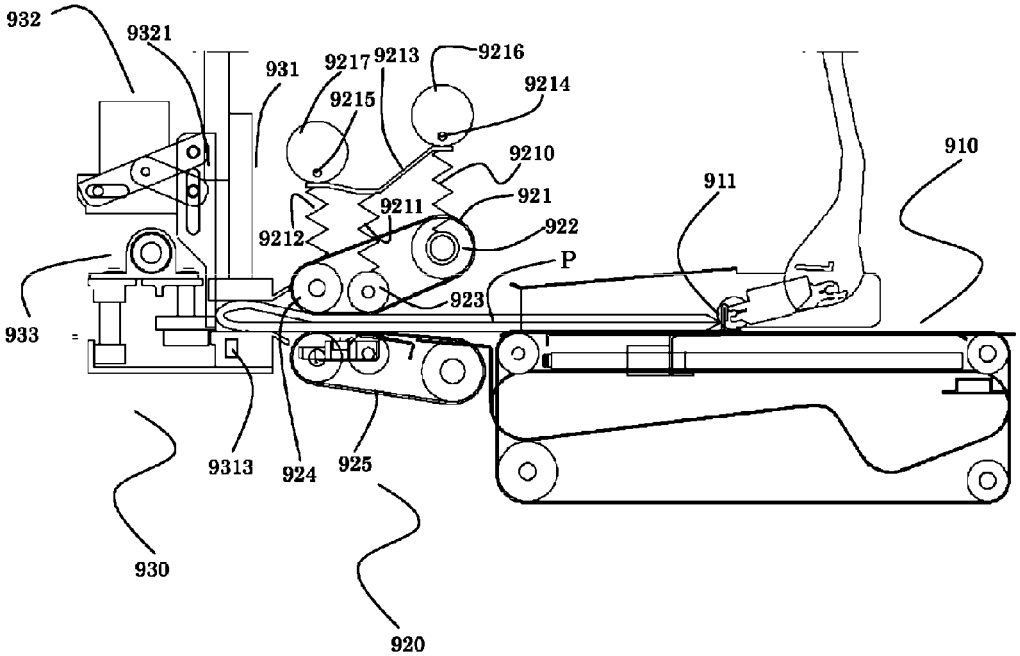
Figure 15:
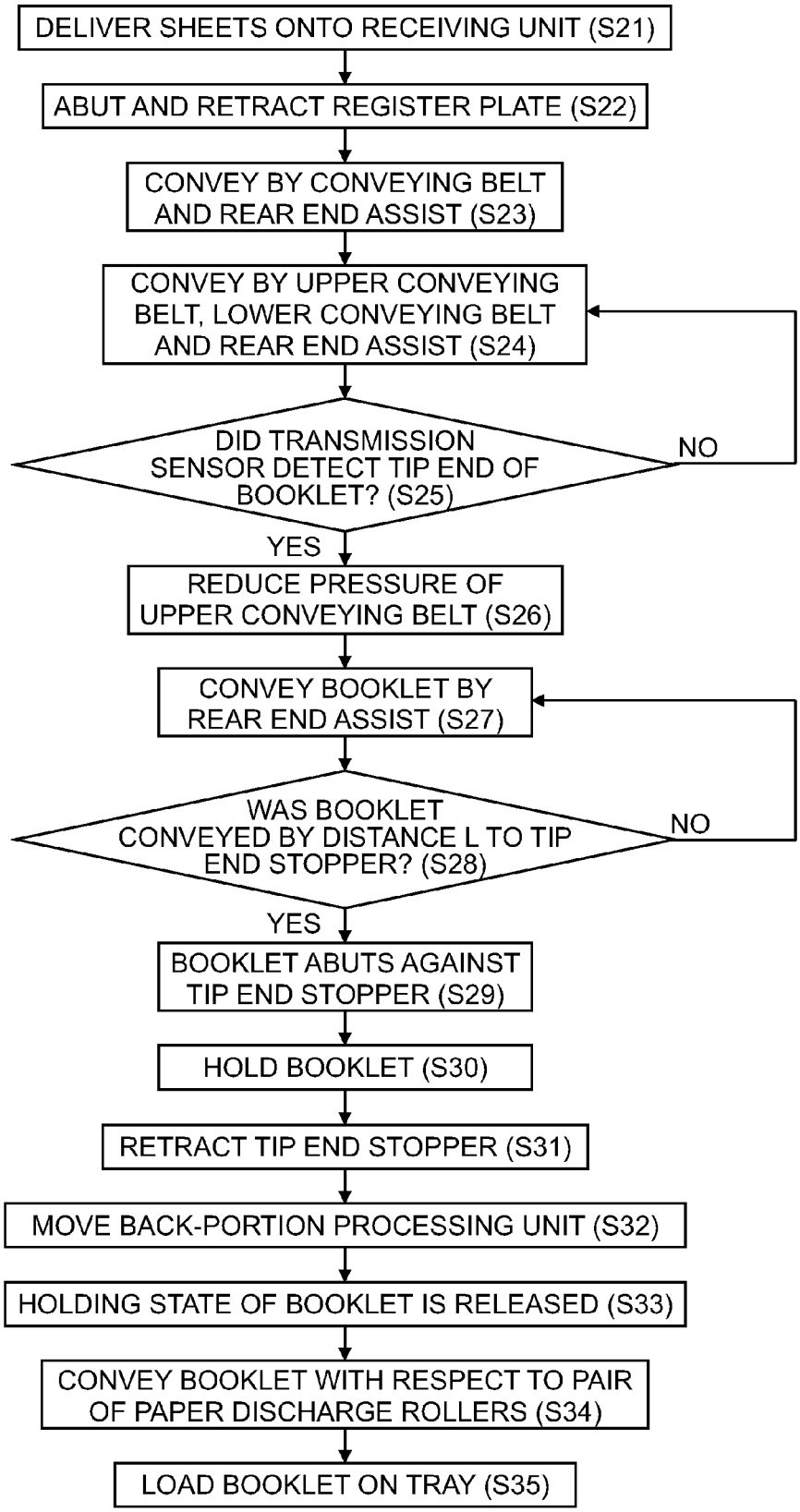
FIG. 15 is a flowchart of motion of the booklet processing apparatus in the second embodiment.

FIGS. 13 and 14 are sectional views of a booklet processing apparatus according to a second embodiment. FIG. 15 is a flowchart illustrating flow of process of the booklet processing apparatus of the second embodiment. The second embodiment is different from the first embodiment only in a configuration of the pair of conveying belts 920, and other configurations are the same as those of the first embodiment. Therefore, only the configuration of the pair of conveying belts and its motion will be described.

First, the configuration of the pair of conveying belts will be described. The pair of conveying belts 920 of the second embodiment includes the upper conveying belt 921 which is the first conveying belt, and a lower conveying belt 925 which is a second conveying belt provided at a position opposed to the upper conveying belt 921 through a conveying path of booklets. The upper conveying belt 921 extends along the pair of belts rollers 922 to 924, and the lower conveying belt 925 extends along the pair of belts rollers 926 to 928. Compression springs 9210 to 9212 are respectively mounted on rollers 922 to 924 which turn the upper conveying belt 921. The compression springs 9210 to 9212 generate forces in the vertical direction, and push the upper conveying belt 921 against the lower conveying belt 925. Upper ends of the compression springs 9210 to 9212 are mounted on a spring holding plate 9213. The spring holding plate 9213 is vertically moved by rotations of the cams 9216 and 9217 around the rotation shafts 9214 and 9215, thereby changing pushing forces of the compression springs 9210 to 9212. That is, a contacting pressure of the upper conveying belt 921 against a booklet can be changed.

Figure 12:
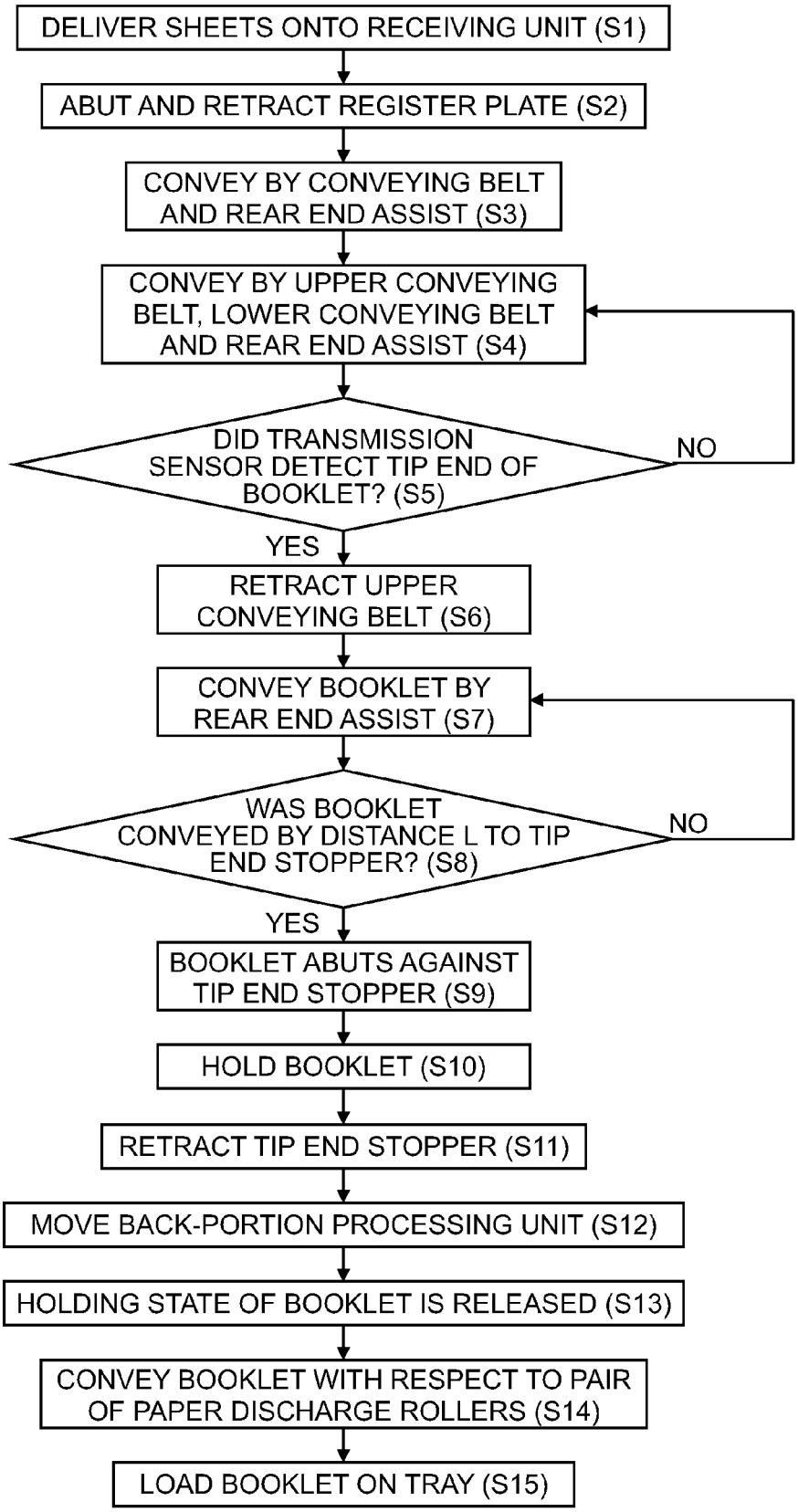
FIG. 12 is a flowchart of motion of the booklet processing apparatus in the first embodiment.

Next, motion of the booklet processing apparatus will be described. S21 to S35 except S26 in FIG. 15 are the same as S1 to S15 except S6 in the flowchart in FIG. 12. In the following description of the motion, flows of motion of S24 to S29 in FIG. 15 are described, the description using FIG. 12 is used for motion of other portions, and redundant description is omitted.

An open end of a booklet P which was conveyed from the receiving unit 910 is pushed out by the rear end assist 911 of the receiving unit 910 and in this state, the booklet P is conveyed by the upper conveying belt 921 and the lower conveying belt 925 (S24). At that time, the cams 9216 and 9217 are located at bottom dead center, and a pressure contacting the booklet is high (FIG. 13). The booklet P is delivered to the back processing unit 930, and if a tip end of the booklet P reaches the detection position (detection line) Y3, it is detected by the transmission sensor 9313 located at the fixing block 9312 (S25). Then, the upper conveying belt 921 and the lower conveying belt 925 stop the conveying operation, the cams 9216 and 9217 move upward to the top dead center, and reduce pressure contacting the booklet P (FIG. 14A, S26). Thereafter, the rear end assist 911 continuously pushes out the fore edge of the booklet P (S27), and the booklet P is conveyed by the distance L from the detection position Y3 to the stopper plate 9321 of the tip end stopper (S28). The back of the booklet P which was conveyed by the distance L by the rear end assist 911 abuts against the stopper plate 9321, and its skew feeding is corrected (FIG. 14B, S29).

Thereafter, like the first embodiment, the booklet P is held by the holding portion 931 and then, the back is sharply folded by the pressure roller unit 933, and the booklet P is loaded on the tray 950 by the pair of conveying belts 920 and the pair of discharge belts 940.

As described above, according to the second embodiment, when the booklet P proceeds the holding region of the holding portion 931, the pressing force of the upper conveying belt 921 against the booklet P is reduced, and the upper conveying belt 921 and the lower conveying belt 925 stop the conveying operation. The rear end assist 911 conveys the booklet P and makes the booklet P abut against the tip end stopper 932. According to this, like the first embodiment, the skew feeding of the booklet P is corrected, sags of several sheets from the outermost sheet to inner sheets are prevented, and it is possible to prevent the quality from being deteriorated when a booklet having a sag is processed.

[Third Embodiment]

Figure 16A:
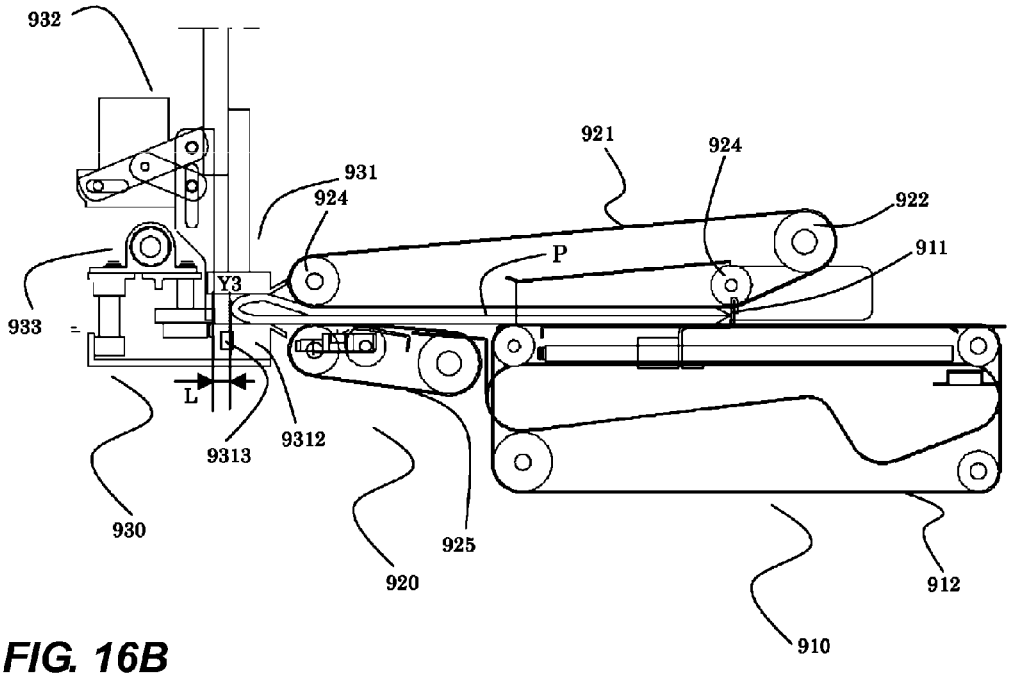
FIGS. 16A and 16B are front sectional views of a booklet processing apparatus illustrating booklet motion in a third embodiment.
Figure 16B:
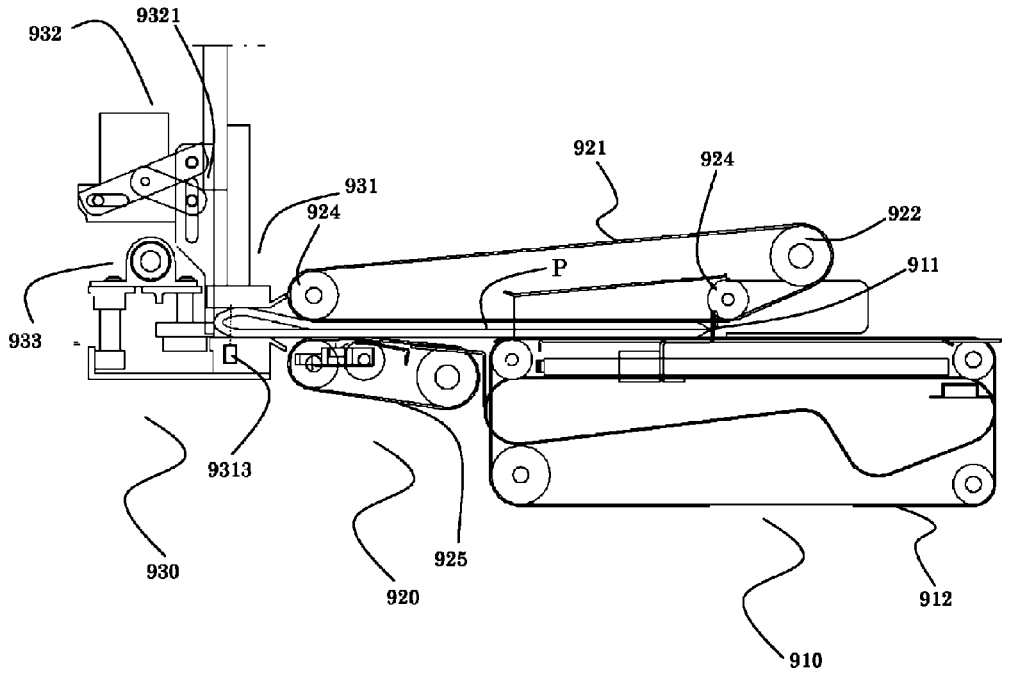
Figure 17:
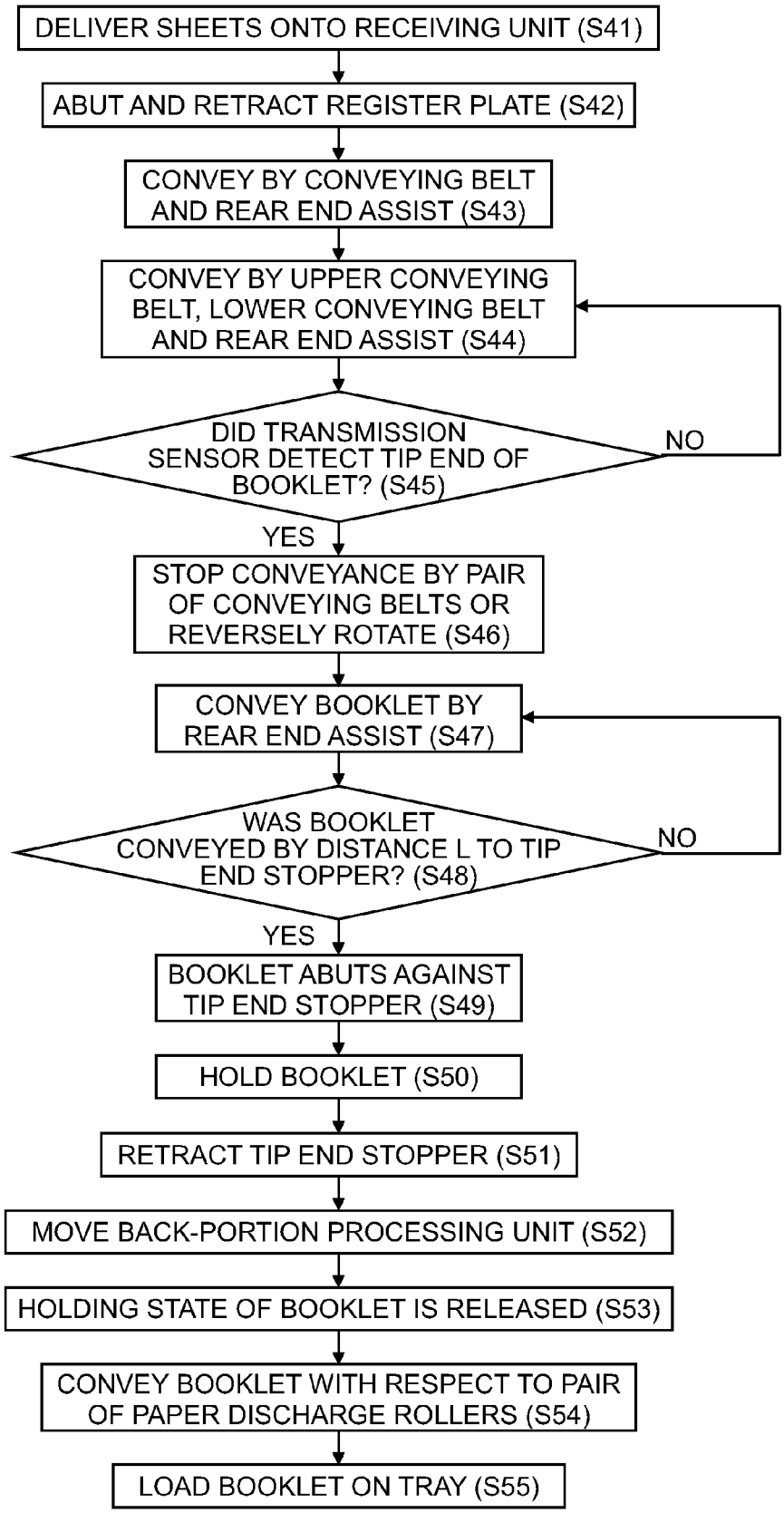
FIG. 17 is a flowchart of motion of the booklet processing apparatus in the third embodiment.
Figure 18A:
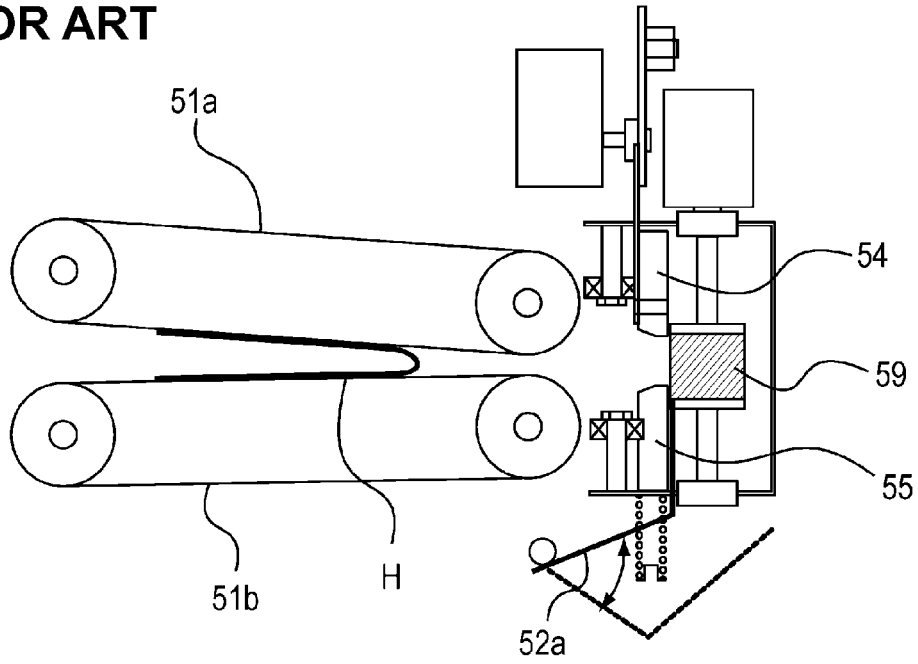
FIG. 18A PRIOR ART
FIGS. 18A and 18B are explanatory diagrams of a conventional technique.
Figure 18B:
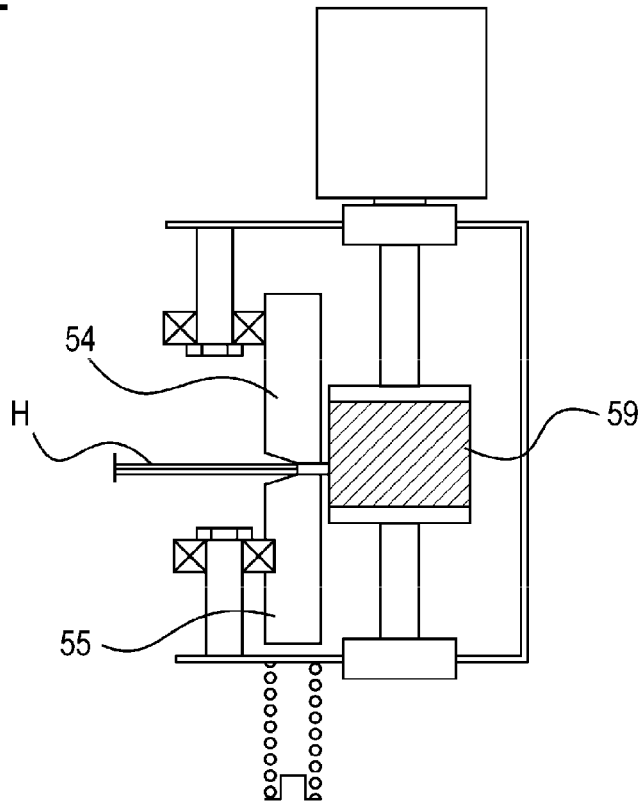
FIG. 18B PRIOR ART
Figure 19A:
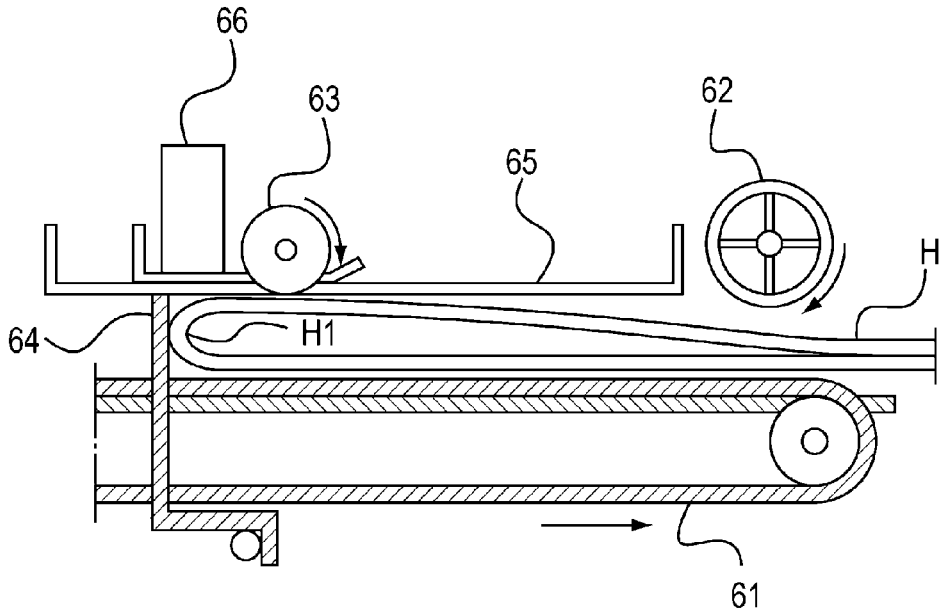
FIG. 19A PRIOR ART
FIGS. 19A and 19B are explanatory diagrams of another conventional technique.
Figure 19B:
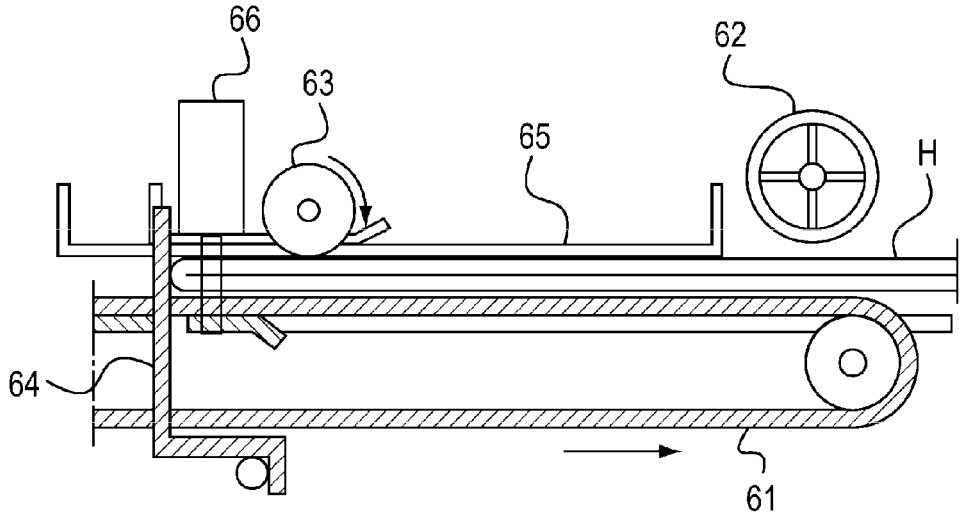
FIG. 19B PRIOR ART
Figure 20A:
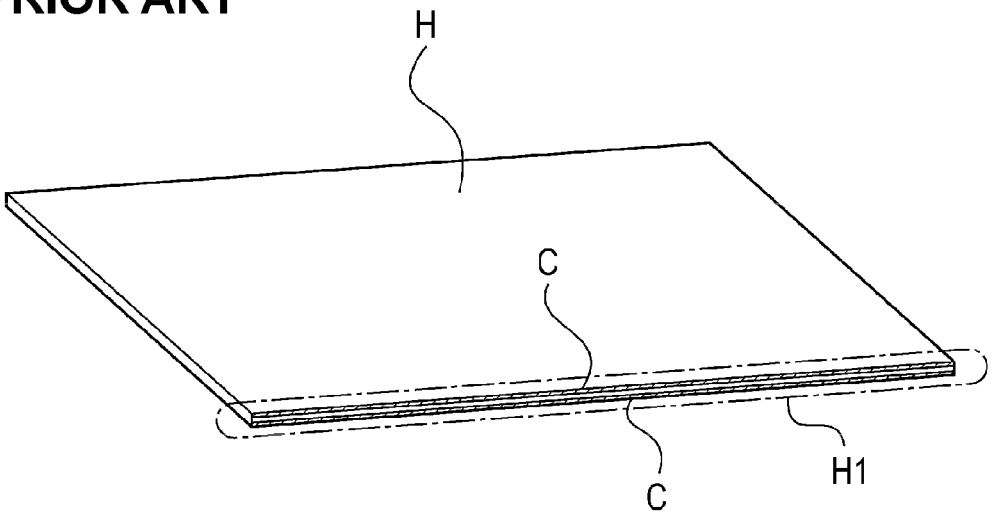
FIG. 20A PRIOR ART
FIG. 20A is a perspective view of a booklet having a back which is sharply folded in a state where the back has a sag.
Figure 20B:
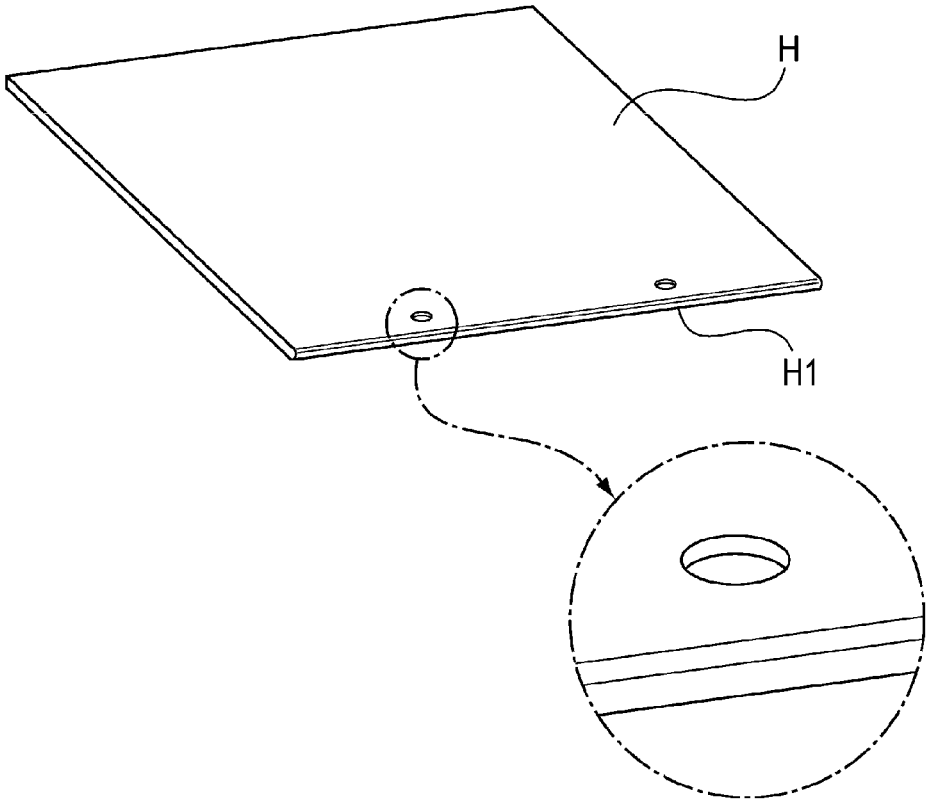
FIG. 20B PRIOR ART
FIG. 20B is a perspective view of a booklet in which a hole is formed in a state where the booklet has a sag.

FIG. 16 is a sectional view of a booklet processing apparatus according to a third embodiment. FIG. 17 is a flowchart illustrating flow of process of the booklet processing apparatus of the third embodiment. The third embodiment is different from the previous embodiments only in a configuration of the pair of conveying belts 920, and other configurations are the same as those of the previous embodiments. Therefore, only the configuration of the pair of conveying belts and its motion will be described.

First, the configuration of the pair of conveying belts will be described. The pair of conveying belts 920 of the third embodiment includes the upper conveying belt 921 which is the first conveying belt, and a lower conveying belt 925 which is a second conveying belt provided at a position opposed to the upper conveying belt 921 through a conveying path of booklets. The upper conveying belt 921 extends along the pair of belts rollers 922 to 924, and the lower conveying belt 925 extends along the pair of belts rollers 926 to 928. The upper conveying belt 921 and the rollers 922 to 924 which turn the upper conveying belt 921 extend from a location above the receiving unit 910 to a location in front of the holding portion 931 as illustrated in FIG. 16A.

Next, motion of the booklet processing apparatus will be described. S41 to S55 except S46 in FIG. 17 are the same as S1 to S15 except S6 in the flowchart in FIG. 12. In the following description of the motion, flows of motion of S44 to S49 in FIG. 17 are described, the description using FIG. 12 is used for motion of other portions, and redundant description is omitted.

An open end of a booklet P is pushed by the rear end assist 911 and in this state, the booklet P is conveyed between the upper conveying belt 921 and the conveying belt 912, and between the upper conveying belt 921 and the lower conveying belt 925 (S44). If a tip end of the booklet P reaches the detection position (detection line) Y3 (FIG. 16A), it is detected by the transmission sensor 9313 located in the fixing block 9312 (S45). Then, the upper conveying belt 921, the lower conveying belt 925 and the conveying belt 912 stop the conveying operation (S46). Thereafter, the rear end assist 911 continuously pushes out the fore edge of the booklet P (S47), and conveys the booklet P by the distance L from the detection position Y3 to the stopper plate 9321 of the tip end stopper (S48). The booklet P which was conveyed by the rear end assist 911 by the distance L, the booklet P abuts against the stopper plate 9321 and the skew feeding is corrected (FIG. 16B, S49).

Thereafter, like the first embodiment, the booklet P is held by the holding portion 931 and then, the back is sharply folded by the pressure roller unit 933, and the booklet P is loaded on the tray 950 by the pair of conveying belts 920 and the pair of discharge belts 940.

According to this embodiment, when the booklet P proceeds the holding region of the holding portion 931, the conveying belts 921, 925 and 912 are stopped, and the conveying operation of the booklet P by the conveying belts is stopped. The rear end assist 911 conveys the booklet P and makes the booklet P abut against the tip end stopper 932. According to this, like the first embodiment, the skew feeding of the booklet P is corrected, sags of several sheets from the outermost sheet to inner sheets are prevented, and it is possible to prevent the quality from being deteriorated when a booklet having a sag is processed.

When the tip end of the booklet reaches the detection position, the upper conveying belt 921, the lower conveying belt 925 and the conveying belt 912 may rotate in the conveying direction of the booklet and in the opposite direction. In this case, when the rear end assist 911 pushes out the booklet P, if the upper conveying belt 921, the lower conveying belt 925 and the conveying belt 912 are rotated in a direction opposite from the conveying direction, a sag of the booklet P can more reliably be prevented.

[Other Embodiments]

In the previous embodiments, the pair of conveying belts which nip the booklet and convey the same are described as the conveying portions which contact the booklet and conveys the same, the invention is not limited to this. For example, one of conveying portions may be a conveying guide which guides a booklet through a conveying path of the booklet, and the other one may be a conveying belt which is opposed to the conveying guide. The upper conveying belt can move toward and away from the booklet, but the invention is not limited to this. The upper side may be a fixed guide and the lower conveying belt may move forward and away from the booklet.

In the previous embodiments, the deforming portion which brings the roller into contact with the back of the booklet under pressure to move the booklet and which deforms the booklet is described as the processing portion which processes the booklet, but the invention is not limited to this. For example, it is possible to employ other processing portion such as a punching portion which punches a hole in the back area of the booklet.

Although the copier is described as the image forming apparatus in the embodiments, the invention is not limited to this. For example, the image forming apparatus may be other image forming apparatus such as a printer and a facsimile machine, or other image forming apparatus such as a multifunctional machine in which the above functions are combined. If the invention is applied to the booklet processing apparatus used for such image forming apparatuses, the same effect can be obtained.

In the previous embodiments, the booklet processing apparatus is integrally provided on the saddle stitch binding portion of the sheet processing apparatus, but the invention is not limited to this. For example, the booklet processing apparatus may be detachably attached to the sheet processing apparatus, and if the invention is applied to the booklet processing apparatus, the same effect can be obtained. The booklet processing apparatus may be detachably attached to the image forming apparatus or the image forming apparatus may integrally provided with the booklet processing apparatus, and if the invention is applied to the booklet processing apparatus, the same effect can be obtained.

According to the present invention, the skew feeding of the booklet can be corrected, sags of several sheets from the outermost sheet to inner sheets can be prevented, and it is possible to prevent the quality from being deteriorated when a booklet having a sag is processed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2009-284651, filed Dec. 16, 2009, and No. 2010-260746, filed Nov. 24, 2010, which are hereby incorporated by reference herein in their entirety.

What is claimed is:

1. A sheet processing apparatus comprising:

a conveying portion which is contactable with and separable from a surface of a doubled up booklet and conveys the booklet;

an end conveying portion which abuts against an open end of the booklet and pushes out the booklet, thereby conveying the booklet;

a stopper which abuts against a back of the booklet to position the booklet;

a holding portion which holds the booklet which abuts against the stopper;

a processing portion which processes the booklet held by the holding portion;

a changing portion which changes a pressure of the conveying portion against the surface of the booklet while the conveying portion contacts the surface of the booklet; and a controlling portion configured to control the changing portion, the end conveying portion, and the holding portion so that the changing portion reduces the pressure of the conveying portion against the surface of the booklet before the back of the booklet conveyed by the conveying portion abuts against the stopper, while the booklet is conveyed by the end conveying portion until the back of the booklet abuts against the stopper and then, the holding portion holds the booklet.

2. The sheet processing apparatus according to claim 1, wherein the processing portion is a deforming portion which moves, along the back, a roller which presses the back of the booklet, and which deforms the back.

3. The sheet processing apparatus according to claim 1, wherein the processing portion is a punching portion which punches a hole in the booklet.

4. The sheet processing apparatus according to claim 1, wherein the conveying portion includes a first conveying belt and a second conveying belt which is provided at a position opposed to the first conveying belt through a conveying path for the booklet.

5. The sheet processing apparatus according to claim 1, wherein the end conveying portion includes a plurality of sending projections, and the end conveying portion moves in parallel to a conveying direction of the booklet.

6. The sheet processing apparatus according to claim 1, wherein the holding portion includes a pair of opposed holding members, and after the back of the booklet proceeds between the holding members, the conveying portion separates from the booklet, or reduces a pressure abutting against the booklet.

7. The sheet processing apparatus according to claim 1, further comprising a folding portion which folds sheets in two, wherein the conveying portion conveys the doubled up booklet.

8. A sheet processing apparatus comprising:

a conveying portion which contacts a doubled up booklet and conveys the booklet, the conveying portion being rotatable in a normal direction to convey the booklet and in a direction opposite to the normal direction;

an end conveying portion which abuts against an open end of the booklet and pushes out the booklet, thereby conveying the booklet;

a stopper which abuts against a back of the booklet to position the booklet;

a holding portion which holds the booklet which abuts against the stopper;

a processing portion which processes the booklet held by the holding portion; and a controlling portion configured to control rotation of the conveying portion so that the rotation in the normal direction of the conveying portion is stopped while the conveying portion contacts the surface of the booklet before the back of the booklet conveyed by the conveying portion abuts against the stopper, or the conveying portion is rotated in the opposite direction while the conveying portion contacts the surface of the booklet before the back of the booklet conveyed by the conveying portion abuts against the stopper, while the booklet is conveyed by the end conveying portion until the back of the booklet is abutted against the stopper and thereafter, the booklet is held by the holding portion.

9. The sheet processing apparatus according to claim 8, wherein the processing portion is a deforming portion which moves, along the back, a roller which presses the back of the booklet, and which deforms the back.

10. The sheet processing apparatus according to claim 8, wherein the processing portion is a punching portion which punches a hole in the booklet.

11. The sheet processing apparatus according to claim 8, wherein the conveying portion includes a first conveying belt and a second conveying belt which is provided at a position opposed to the first conveying belt through a conveying path for the booklet.

12. The sheet processing apparatus according to claim 8, wherein the end conveying portion includes a plurality of sending projections, and the end conveying portion moves in parallel to a conveying direction of the booklet.

13. The sheet processing apparatus according to claim 8, wherein the holding portion includes a pair of opposed holding members, and after the back of the booklet proceeds between the holding members, the conveying portion separates from the booklet, or reduces a pressure abutting against the booklet.

14. The sheet processing apparatus according to claim 8, further comprising a folding portion which folds sheets in two, wherein the conveying portion conveys the doubled up booklet.

15. An image forming apparatus comprising:

an image forming portion that forms an image on a sheet; and a sheet processing apparatus which folds a sheet in two to make a booklet, and which processes the booklet, wherein the sheet processing apparatus comprises:

a conveying portion which is contactable with and separable from a surface of a doubled up booklet and conveys the booklet;

an end conveying portion which abuts against an open end of the booklet and pushes out the booklet, thereby conveying the booklet;

a stopper which abuts against a back of the booklet to position the booklet;

a holding portion which holds the booklet which abuts against the stopper;

a processing portion which processes the booklet held by the holding portion;

a changing portion which changes a pressure of the conveying portion against the surface of the booklet while the conveying potion contacts the surface of the booklet; and a controlling portion configured to control the changing portion, the end conveying portion and the holding portion so that the changing portion reduces the pressure of the conveying portion against the surface of the booklet before the back of the booklet abuts against the stopper, while the booklet is conveyed by the end conveying portion until the back of the booklet abuts against the stopper and then, the holding portion holds the booklet.

16. The image forming apparatus according to claim 15, wherein the processing portion is a deforming portion which moves, along the back, a roller which presses the back of the booklet, and which deforms the back.

17. The image forming apparatus according to claim 15, wherein the holding portion includes a pair of opposed holding members, and after the back of the booklet proceeds between the holding members, the conveying portion separates from the booklet, or reduces a pressure abutting against the booklet.

18. The image forming apparatus according to claim 15, wherein the conveying portion includes a first conveying belt and a second conveying belt which is provided at a position opposed to the first conveying belt through a conveying path for the booklet.

19. The image forming apparatus according to claim 15, wherein the end conveying portion includes a plurality of sending projections, and the end conveying portion moves in parallel to a conveying direction of the booklet.

20. An image forming apparatus comprising:

an image forming portion that forms an image on a sheet; and a sheet processing apparatus which folds a sheet into two to make a booklet, and which processes the booklet, wherein the sheet processing apparatus comprises:

a conveying portion which contacts a doubled up booklet and conveys the booklet, the conveying portion being rotatable in a normal direction to convey the booklet and in a direction opposite to the normal direction;

an end conveying portion which abuts against an open end of the booklet and pushes out the booklet, thereby conveying the booklet;

a stopper which abuts against a back of the booklet to position the booklet;

a holding portion which holds the booklet which abuts against the stopper;

a processing portion which processes the booklet held by the holding portion;

a controlling portion configured to control rotation of the conveying portion so that the rotation in the normal direction of the conveying portion is stopped while the conveying portion contacts the surface of the booklet before the back of the booklet conveyed by the conveying portion abuts against the stopper, or the conveying portion is rotated in the opposite direction while the conveying portion contacts the surface of the booklet before the back of the booklet conveyed by the conveying portion abuts against the stopper, while the booklet is conveyed by the end conveying portion until the back of the booklet is abutted against the stopper and thereafter, the booklet is held by the holding portion.

21. The image forming apparatus according to claim 20, wherein the processing portion is a deforming portion which moves, along the back, a roller which presses the back of the booklet, and which deforms the back.

22. The image forming apparatus according to claim 20, wherein the holding portion includes a pair of opposed holding members, and after the back of the booklet proceeds between the holding members, the conveying portion separates from the booklet, or reduces a pressure abutting against the booklet.

23. The image forming apparatus according to claim 20, wherein the conveying portion includes a first conveying belt and a second conveying belt which is provided at a position opposed to the first conveying belt through a conveying path for the booklet.

24. The image forming apparatus according to claim 20, wherein the end conveying portion includes a plurality of sending projections, and the end conveying portion moves in parallel to a conveying direction of the booklet.

* * * * *